US010975635B2

(12) United States Patent
Gupta et al.

(10) Patent No.: US 10,975,635 B2
(45) Date of Patent: Apr. 13, 2021

(54) AUTOMATED DRILLING RIG SYSTEM

(71) Applicant: Nabors Drilling Technologies USA, Inc., Houston, TX (US)

(72) Inventors: Ashish Gupta, Houston, TX (US); Derek Patterson, Houston, TX (US); Padira Reddy, Richmond, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 37 days.

(21) Appl. No.: 16/661,059

(22) Filed: Oct. 23, 2019

(65) Prior Publication Data

US 2020/0123861 A1 Apr. 23, 2020

Related U.S. Application Data

(60) Provisional application No. 62/760,716, filed on Nov. 13, 2018, provisional application No. 62/749,668, filed on Oct. 23, 2018.

(51) Int. Cl.

| | |
|---|---|
| ***E21B 19/15*** | (2006.01) |
| ***E21B 19/16*** | (2006.01) |
| ***E21B 15/00*** | (2006.01) |
| ***E21B 19/14*** | (2006.01) |

(52) U.S. Cl.

CPC ..... *E21B 19/155* (2013.01); *E21B 15/003* (2013.01); *E21B 19/14* (2013.01); *E21B 19/161* (2013.01)

(58) Field of Classification Search

CPC ..... E21B 19/14; E21B 19/15; E21B 19/155; E21B 19/161; E21B 15/003

See application file for complete search history.

(56) References Cited

U.S. PATENT DOCUMENTS

| | | | | |
|---|---|---|---|---|
| 4,235,566 | A * | 11/1980 | Beeman | E21B 19/155 175/85 |
| 7,537,424 | B2 * | 5/2009 | Innes | E21B 7/02 211/70.4 |
| 8,192,127 | B2 * | 6/2012 | Angman | E21B 19/155 414/22.52 |
| 9,562,406 | B2 * | 2/2017 | Yorga | E21B 19/155 |
| 9,631,443 | B2 * | 4/2017 | Folk | E21B 19/155 |
| 10,267,105 | B2 * | 4/2019 | Folk | E21B 19/155 |
| 10,662,725 | B1 * | 5/2020 | Morelli | E21B 19/155 |

(Continued)

*Primary Examiner* — Nicole Coy

(74) *Attorney, Agent, or Firm* — Locklar PLLC

(57) ABSTRACT

An automated drilling rig system includes a drilling rig and a catwalk system. The drilling rig includes a rig floor, a substructure, a mast, a top drive, and a pipe handling apparatus. The pipe handling apparatus includes a column coupled to the rig floor at a position offset from the well centerline. The catwalk system includes a pipe tub, a catwalk lift frame, and a catwalk assembly. The pipe tub is configured to store one or more tubular members for use with the drilling rig. The catwalk assembly includes a base and a catwalk slide. The catwalk lift frame is coupled to the base of the catwalk assembly and extends substantially vertically to the rig floor. The catwalk slide is coupled to the catwalk lift frame at a first end and pivotably coupled to the base at a second end via a leveling strut. The catwalk slide includes a skate adapted to slide along the length of the catwalk slide.

51 Claims, 37 Drawing Sheets

(56) References Cited

U.S. PATENT DOCUMENTS

| | | | | |
|---|---|---|---|---|
| 2017/0204687 | A1* | 7/2017 | Yorga | E21B 19/14 |
| 2018/0328125 | A1* | 11/2018 | Folk | E21B 15/00 |
| 2020/0291767 | A1* | 9/2020 | Kroslid | E21B 41/00 |
| 2021/0002995 | A1* | 1/2021 | Botnan | E21B 47/06 |

* cited by examiner

AUTOMATED DRILLING RIG SYSTEM

CROSS-REFERENCE TO RELATED APPLICATION

This application is a nonprovisional application that claims priority from U.S. provisional application No. 62/749,668, filed Oct. 23, 2018, and from U.S. provisional application No. 62/760,716, filed Nov. 13, 2018, each of which is hereby incorporated by reference.

TECHNICAL FIELD

Field of the Disclosure

The present disclosure relates to the drilling of wells, and specifically to a drilling rig system for use in a wellsite

Background of the Disclosure

When drilling a wellbore, a drilling rig is positioned at the site of the wellbore to be formed, defining a wellsite. The drilling rig may be used to drill the wellbore. Additional wellsite equipment may be utilized with the drilling rig. The additional wellsite equipment may include, for example and without limitation, one or more generators, fuel tanks, variable frequency drives (VFDs), mud pumps, suction tanks, intermediate tanks, sack houses, parts houses, charge pumps, service skids, water tanks, and mud process tanks. Traditionally, the additional wellsite equipment may be positioned about the drilling rig on multiple sides of the drilling rig.

SUMMARY

The present disclosure provides for an automated drilling rig system. The automated drilling rig system may include a drilling rig and a catwalk system. The drilling rig may include a rig floor, a substructure, a mast, a top drive, and a pipe handling apparatus. The pipe handling apparatus may include a column coupled to the rig floor at a position offset from the well centerline. The catwalk system may include a pipe tub, a catwalk lift frame, and a catwalk assembly. The catwalk lift frame may be coupled to the rig floor. The catwalk assembly may include a base and a catwalk slide. The catwalk lift frame may be coupled to the base of the catwalk assembly and may extend substantially vertically to the rig floor. The pipe tub may be coupled to the catwalk assembly by one or more struts. The catwalk slide may be coupled to the catwalk lift frame at a first end and pivotably coupled to the base at a second end via a leveling strut. The catwalk slide may include a skate adapted to slide along the length of the catwalk slide.

The present disclosure also provides for a catwalk system. The catwalk system may include a pipe tub, a catwalk lift frame, and a catwalk assembly. The catwalk lift frame may be coupled to the rig floor. The catwalk assembly may include a base and a catwalk slide. The catwalk lift frame may be coupled to the base of the catwalk assembly and may extend substantially vertically to the rig floor. The pipe tub may be coupled to the catwalk assembly by one or more struts. The catwalk slide may be coupled to the catwalk lift frame at a first end and pivotably coupled to the base at a second end via a leveling strut. The catwalk slide may include a skate adapted to slide along the length of the catwalk slide.

The present disclosure also provides for a generator skid. The generator skid may include a trailer having one or more sets of wheels and a hitch, a generator positioned on the trailer, and one or more power delivery cable arms adapted to extend from the generator skid to another piece of equipment. The power delivery cable arms may be pivotably coupled to the trailer The present disclosure also provides for a driller's cabin for a drilling rig. The driller's cabin may include a control station pivotably mounted within the driller's cabin. The control station may be pivotable between a position facing away from a window of the driller's cabin and a position facing toward the window of the driller's cabin.

The present disclosure also provides for a method. The method may include providing a drilling rig. The drilling rig may include a rig floor, a substructure, a mast, a top drive, and a pipe handling apparatus. The pipe handling apparatus may include a column coupled to the rig floor at a position offset from the well centerline. The method may further include coupling a catwalk system to the drilling rig. The catwalk system may include a pipe tub, a catwalk lift frame, and a catwalk assembly. The catwalk lift frame may be coupled to the rig floor. The catwalk assembly may include a base and a catwalk slide. The catwalk lift frame may be coupled to the base of the catwalk assembly and may extend substantially vertically to the rig floor. The pipe tub may be coupled to the catwalk assembly by one or more struts. The catwalk slide may be coupled to the catwalk lift frame at a first end and pivotably coupled to the base at a second end via a leveling strut. The catwalk slide may include a skate adapted to slide along the length of the catwalk slide. The method may further include moving a tubular member from the pipe tub to the catwalk slide, raising the catwalk slide to the rig floor along the lift frame, moving the tubular member along the catwalk slide and over the rig floor using the skate, and engaging the tubular member with the pipe handling apparatus.

The present disclosure also provides for a method. The method may include providing a catwalk system. The catwalk system may include a pipe tub, a catwalk lift frame, and a catwalk assembly. The catwalk lift frame may be coupled to the rig floor. The catwalk assembly may include a base and a catwalk slide. The catwalk lift frame may be coupled to the base of the catwalk assembly and may extend substantially vertically to the rig floor. The pipe tub may be coupled to the catwalk assembly by one or more struts. The catwalk slide may be coupled to the catwalk lift frame at a first end and pivotably coupled to the base at a second end via a leveling strut. The catwalk slide may include a skate adapted to slide along the length of the catwalk slide. The method may further include raising the first tubular member above the frame of the pipe tub using the support frame, rolling the tubular along the one or more struts, and receiving the tubular with the catwalk slide.

The present disclosure also provides for a method. The method may include providing a drilling rig. The drilling rig may include a rig floor, a substructure, a mast, a top drive, and a pipe handling apparatus. The pipe handling apparatus may include a column coupled to the rig floor at a position offset from the well centerline. The method may further include providing a catwalk system. The catwalk system may include a pipe tub, a catwalk lift frame, and a catwalk assembly. The catwalk lift frame may be coupled to the rig floor. The catwalk assembly may include a base and a catwalk slide. The catwalk lift frame may be coupled to the base of the catwalk assembly and may extend substantially vertically to the rig floor. The pipe tub may be coupled to the catwalk assembly by one or more struts. The catwalk slide may be coupled to the catwalk lift frame at a first end and pivotably coupled to the base at a second end via a leveling strut. The catwalk slide may include a skate adapted to slide along the length of the catwalk slide. The method may include coupling the catwalk system to the drilling rig such that the catwalk slide is offset from the mast, decoupling the catwalk system from the drilling rig, moving the catwalk system along the ground until the catwalk slide is aligned on-center with the mast, and coupling the catwalk system to the drilling rig.

The present disclosure also provides for a method. The method may include providing a drilling rig and transporting a generator skid to a position proximate the drilling rig. The generator skid may include a trailer having one or more sets of wheels and a hitch, a generator positioned on the trailer, and one or more power delivery cable arms adapted to extend from the generator skid to another piece of equipment. The power delivery cable arms may be pivotably coupled to the trailer. The method may include extending a power delivery cable arm, defining a rig cable arm, from the generator skid and operatively coupling the power delivery cable arm to the drilling rig.

The present disclosure also provides for a method. The method may include providing a drilling rig including a rig floor and a driller's cabin positioned on the rig floor. The driller's cabin may include a window and a control station. The control station may be pivotably mounted within the driller's cabin. The method may further include positioning the control station to face toward the window of the driller's cabin and pivoting the control station to face away from the window of the driller's cabin.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
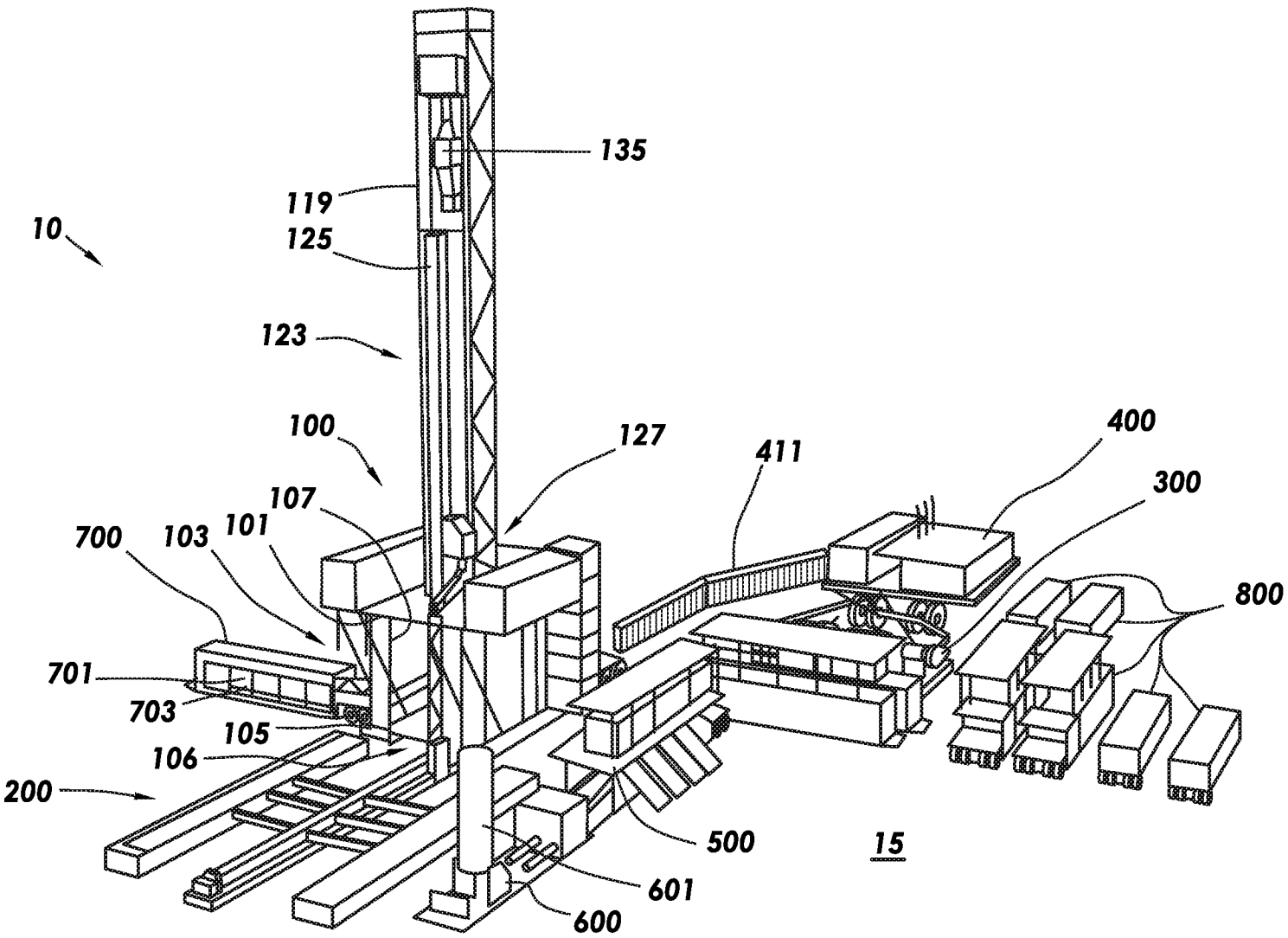
FIGS. 1-4 depict perspective views of an automated drilling rig system consistent with at least one embodiment of the present disclosure.
Figure 2:
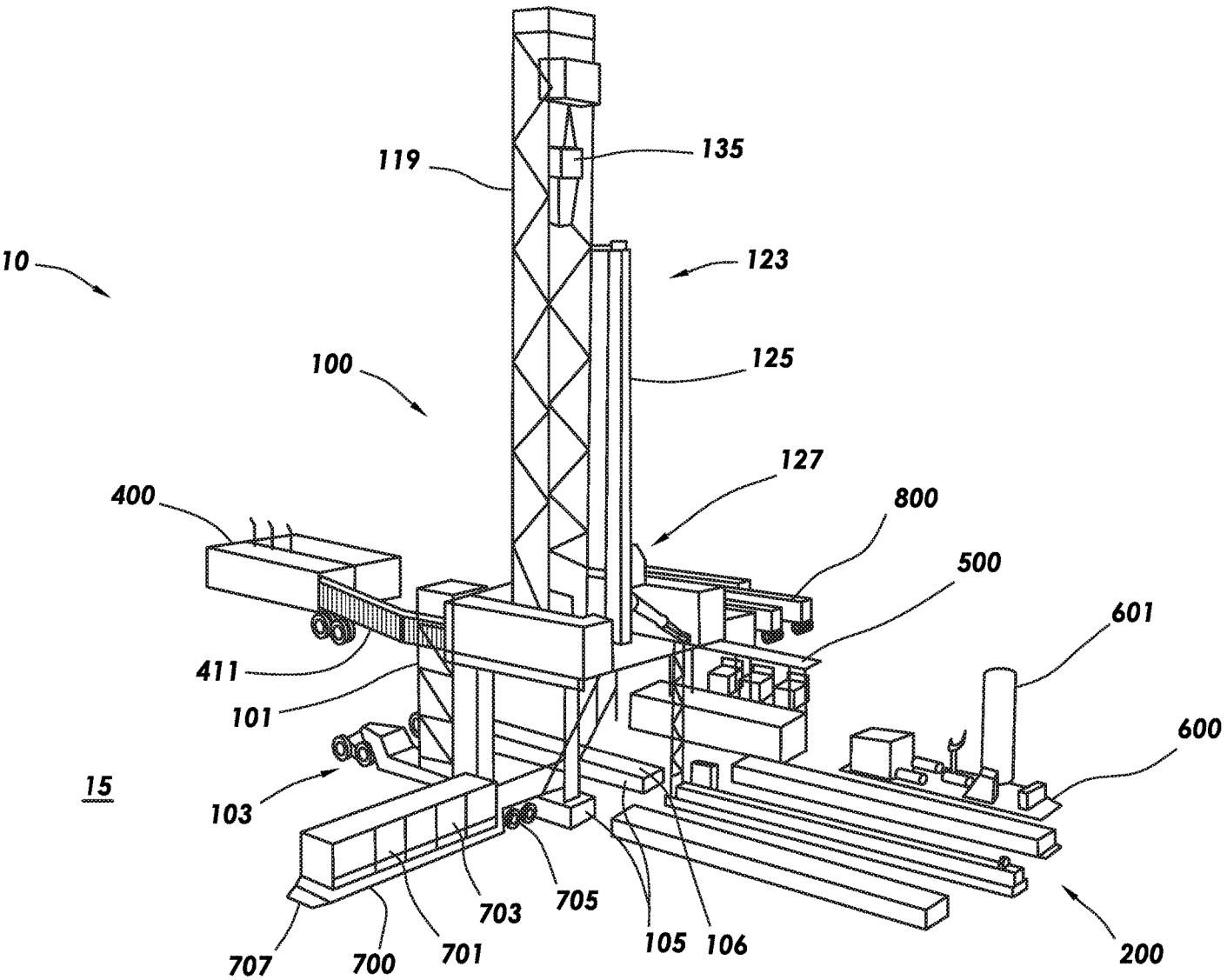
Figure 3:
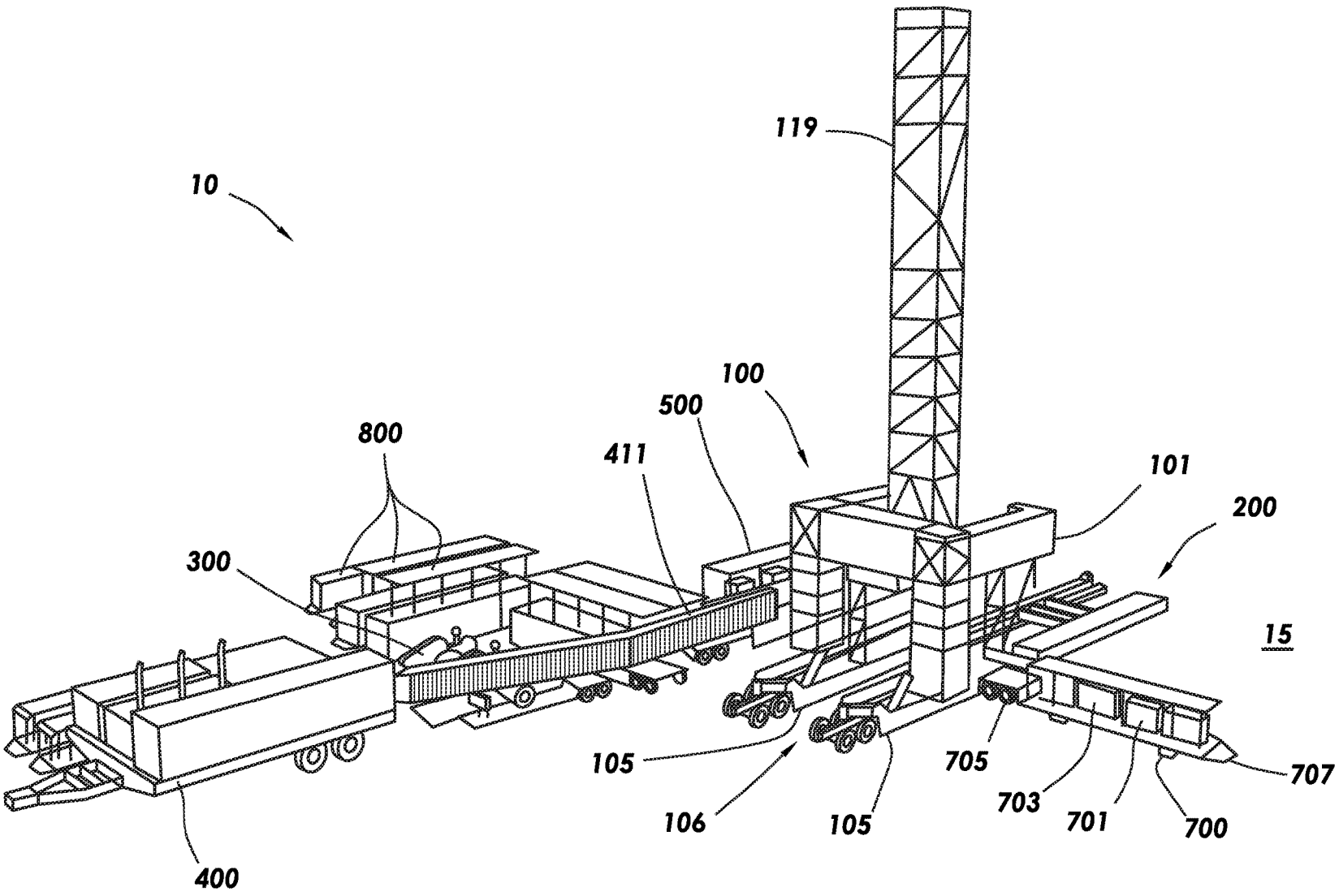
Figure 4:
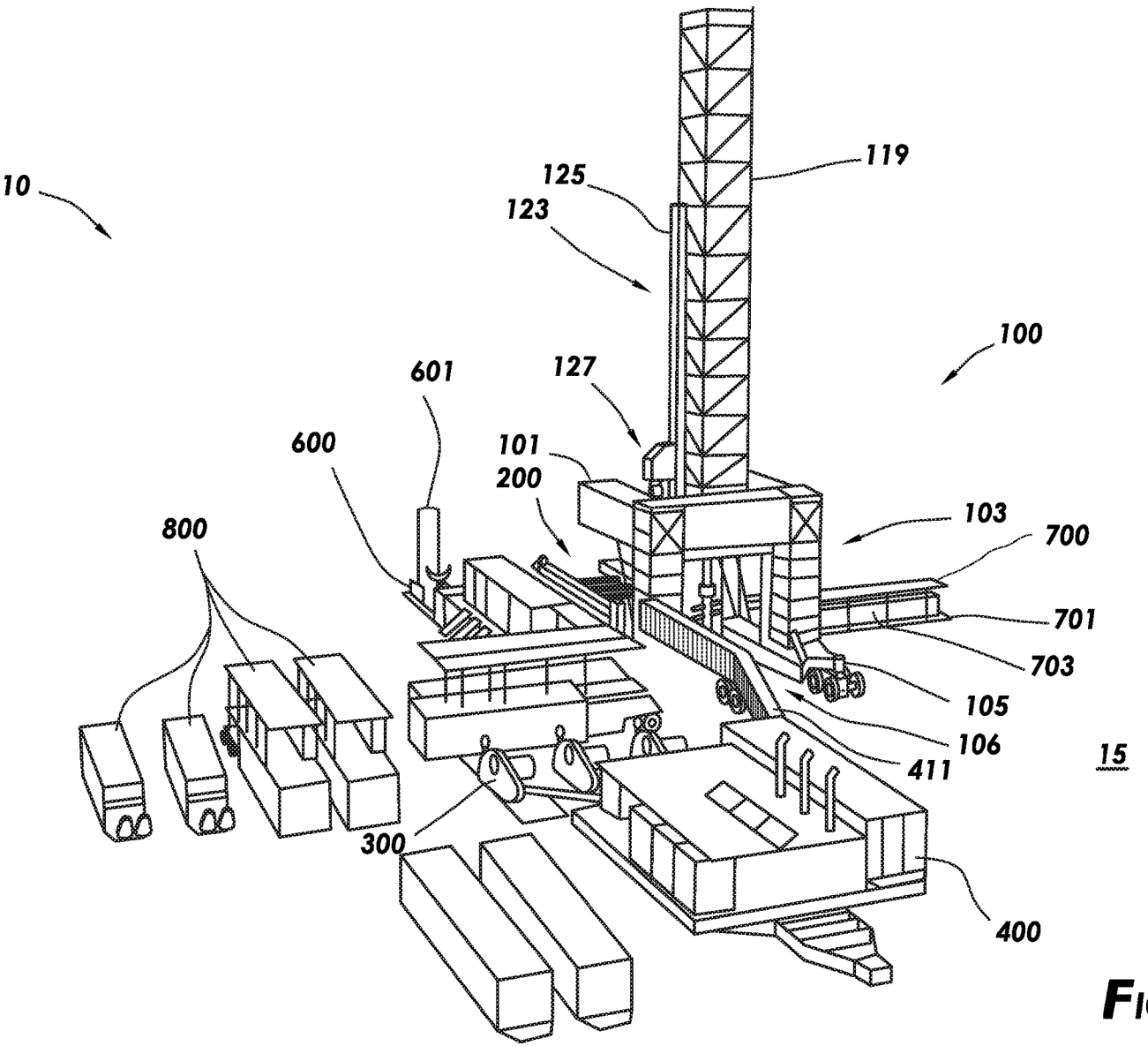

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In some embodiments, as depicted in FIGS. 1-5, automated drilling rig system 10 may include drilling rig 100. Drilling rig 100 may be used to drill or otherwise conduct operations on a wellbore. In some embodiments, automated drilling rig system 10 may include catwalk system 200. Catwalk system 200 may store tubular members for use with automated drilling rig system 10 and may transport the tubular members onto drilling rig 100. In some embodiments, automated drilling rig system 10 may include one or more pump skids 300. Pump skids 300 may be used to provide drilling fluids, such as drilling mud, to drilling rig 100 for use during wellbore operations. In some embodiments, automated drilling rig system 10 may include generator skid 400. Generator skid 400 may be used to provide electrical power to drilling rig 100 and other components of automated drilling rig system 10. In some embodiments, automated drilling rig system 10 may include mud processing skid 500. Mud processing skid 500 may be used to process drilling fluids returning from the wellbore by, for example and without limitation, separating out solids and gases from the returning drilling fluid. In some embodiments, automated drilling rig system 10 may include mud gas separator skid 600. Mud gas separator skid 600 may be used to separate gases from the liquid part of drilling fluids returning from the wellbore. In some embodiments, automated drilling rig system 10 may include HPU skid 700. HPU skid 700 may be used to provide hydraulic power to one or more components of drilling rig 100 or other components of automated drilling rig system 10 such as a BOP as further described below. In some embodiments, automated drilling rig system 10 may further include one or more tank skids 800. Each tank skid may include one or more tanks to hold fluids for use with drilling rig 100 or other components of automated drilling rig system 10. Each component may be separately transported to wellsite 15.

In some embodiments, the various components of automated drilling rig system 10 may be in communication such that control over each system may be accomplished from a central location. In some embodiments, automated drilling rig system 10 may be configured such that operation of drilling rig 100 may be achieved without any human interaction outside of a central control location, such as a driller's cabin as further described below. In some embodiments, by connecting each system of automated drilling rig system 10, once each such component is properly positioned within wellsite 15 and deployed, automated drilling rig system 10 may operate without any human interaction. Such automation may be advantageous in hostile environments such as, for example and without limitation, in a desert environment. As opposed to mechanized rigs in which a central control location is utilized to control each operation of the components of a drilling rig system, automated drilling rig system 10 may be operated such that all operations are fully automated without the need for human interaction. For example, drilling operations including, for example and without limitation, tripping in, tripping out, and drilling may be accomplished fully automatically once the command to initiate such an operation is received.

Additionally, as further described below, automated drilling rig system 10 may be adapted to switch between the fully automated mode and a manual mode with minimal human interaction. For example and without limitation, catwalk system 200 of automated drilling rig system 10 may be movable between a position where pipe handing apparatus 123 is used during operations of drilling rig 100 and a position in which pipe elevator 143 is used. In some embodiments, pipe handling apparatus 123 may be positioned on drilling rig 100 such that such manual operations can be carried out once catwalk system 200 has moved. These aspects of the present disclosure are discussed further herein below.

Figure 6:
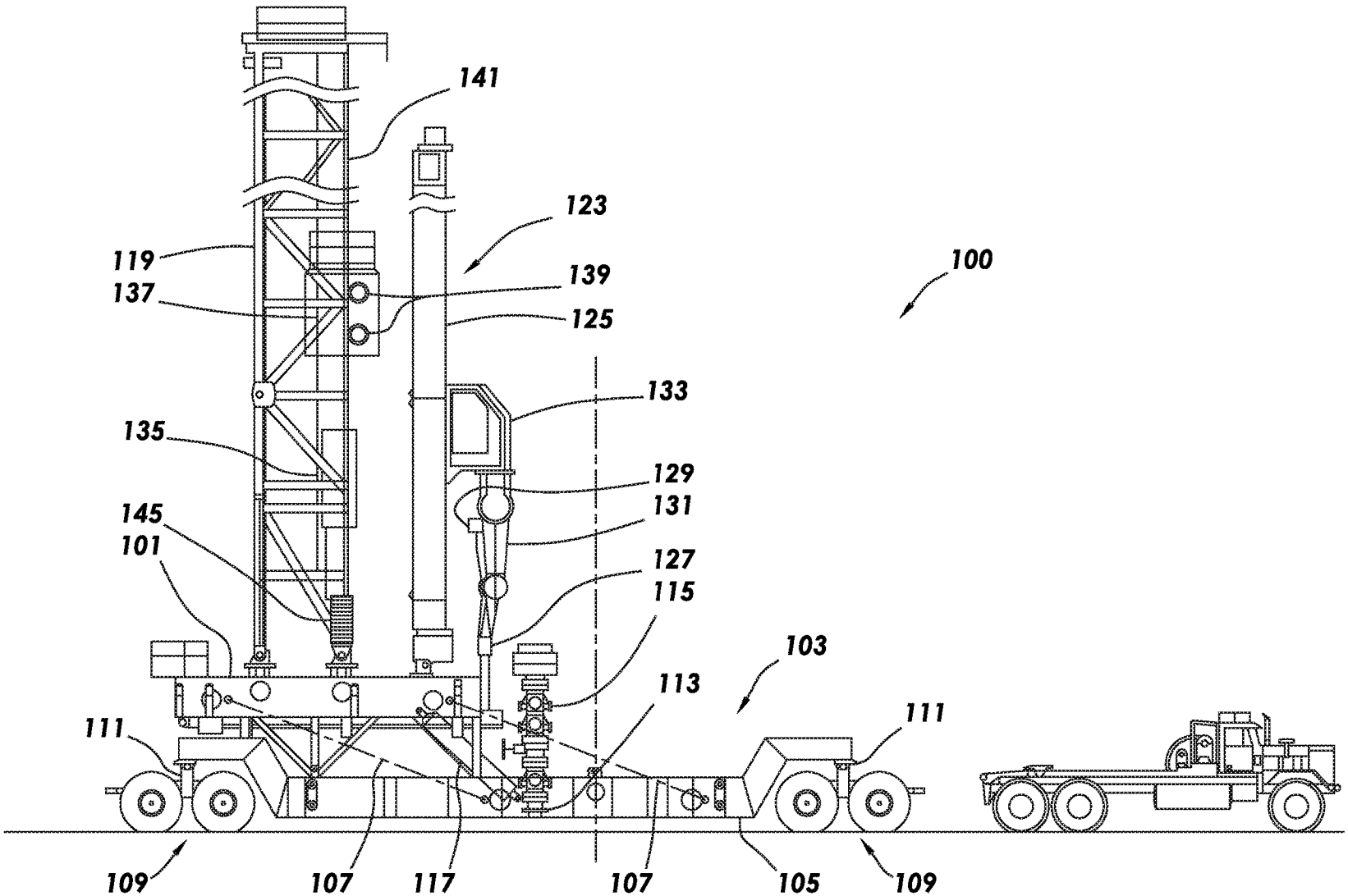
FIG. 6 depicts a side view of a drilling rig consistent with at least one embodiment of the present disclosure with the rig floor in a transport position.
Figure 7:
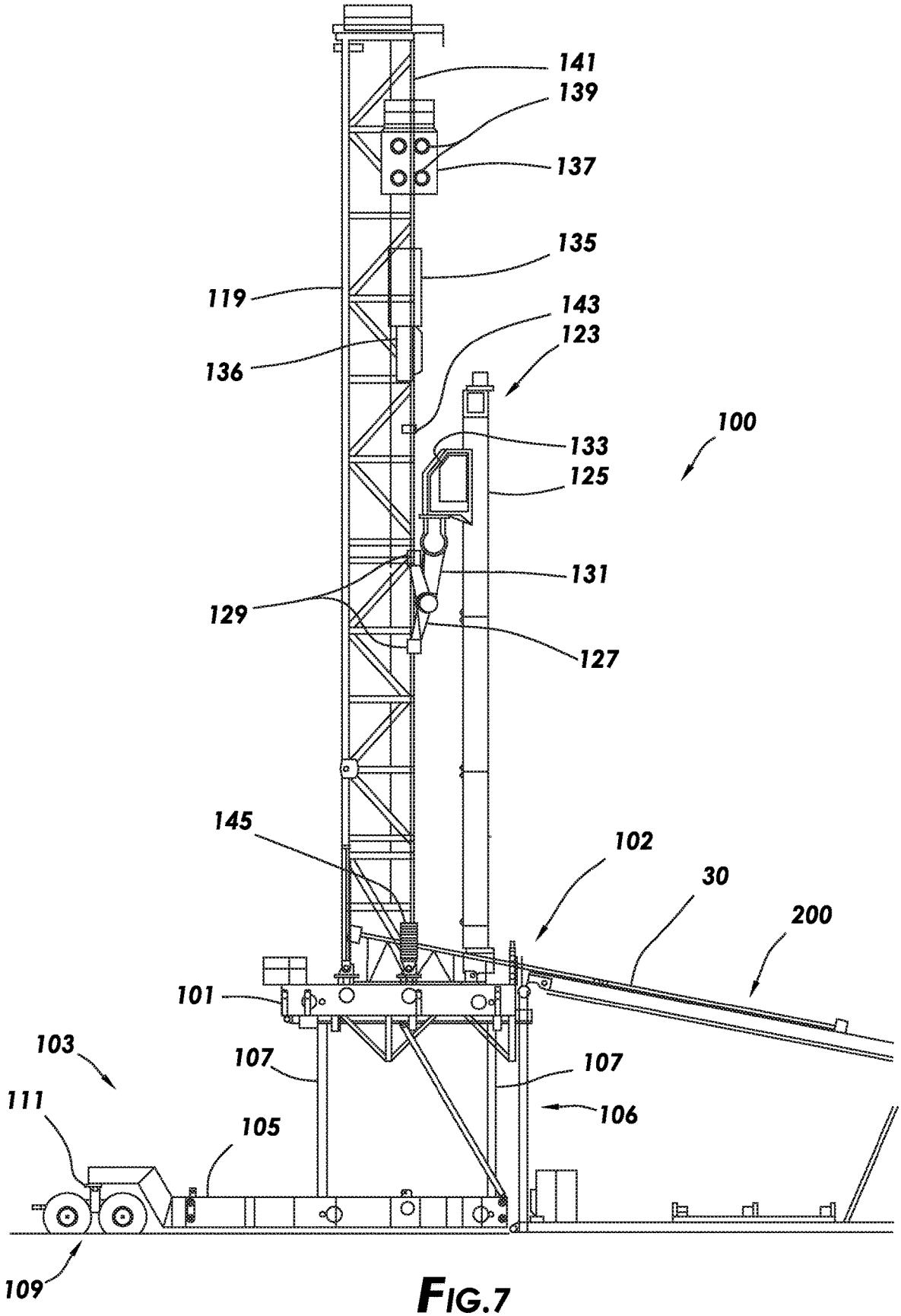
FIG. 7 depicts a side view of the drilling rig of FIG. 6 with the rig floor in a deployed position.

In some embodiments, with respect to FIGS. 6 and 7, drilling rig 100 may include rig floor 101 and substructure 103. Substructure 103 may be the components of drilling rig 100 that support rig floor 101 above the ground. Substructure 103 may include lower boxes 105 and one or more struts 107. Lower boxes 105 may be the components of substructure 103 that abut the ground when drilling rig 100 is in its operational configuration to support rig floor 101. Struts 107 may be pivotably coupled to lower boxes 105 and to rig floor 101. As further discussed below, struts 107 may allow rig floor 101 to pivot between a lowered transport position and a raised deployed position. In some embodiments, lower boxes 105 may be elongated members that are generally parallel and spaced apart horizontally, the space between lower boxes 105 defining substructure corridor 106.

In some embodiments, each lower box 105 may be coupled to one or more sets of wheels, referred to herein as trucks 109. Trucks 109 may be permanently coupled to lower boxes 105 or may be removable therefrom. Trucks 109 may be used to transport drilling rig 100 by, for example and without limitation, towing. Trucks 109 may be coupled to lower boxes 105 such that lower boxes 105 are above the ground, allowing drilling rig 100 to be transported without sliding as shown in FIG. 6.

In some embodiments, lower boxes 105 may be coupled to trucks 109 by transport lifting cylinders 111. Transport lifting cylinders 111 may, for example and without limitation, vertically lift lower boxes 105 off the ground for transportation as shown in FIG. 6, while allowing lower boxes 105 to be lowered into contact with the ground once drilling rig 100 is in the desired position as depicted in FIG. 7. In some embodiments, transport lifting cylinders 111 may be hydraulic cylinders.

In some embodiments, substructure 103 may include blowout preventer (BOP) transport cradle 113. BOP transport cradle 113 may be coupled to lower boxes 105 in the space between lower boxes 105. BOP transport cradle 113 may allow BOP 115 to be transported with drilling rig 100. In some embodiments, BOP transport cradle 113 may include a test flange used, for example and without limitation, during operational and pressure testing of BOP 115. In some embodiments, BOP transport cradle 113 may position BOP 115 above well center. In some embodiments, BOP transport cradle 113 may position BOP 115 such that BOP 115 may remain coupled to BOP transport cradle 113 when rig floor 101 is moved between the lowered transport position and the raised deployed position as further described below.

In some embodiments, once drilling rig 100 is in the desired position and lower boxes 105 have been lowered to the ground by transport lifting cylinders 111, rig floor 101 may be lifted from the lowered transport position as shown in FIG. 6 to the raised deployed position as depicted in FIG. 7. In some embodiments, substructure 103 may include one or more rig floor lifting cylinders 117. Each rig floor lifting cylinder 117 may mechanically couple between a lower box 105 and rig floor 101. In some embodiments, rig floor lifting cylinders 117 may be hydraulic cylinders.

Figure 5:
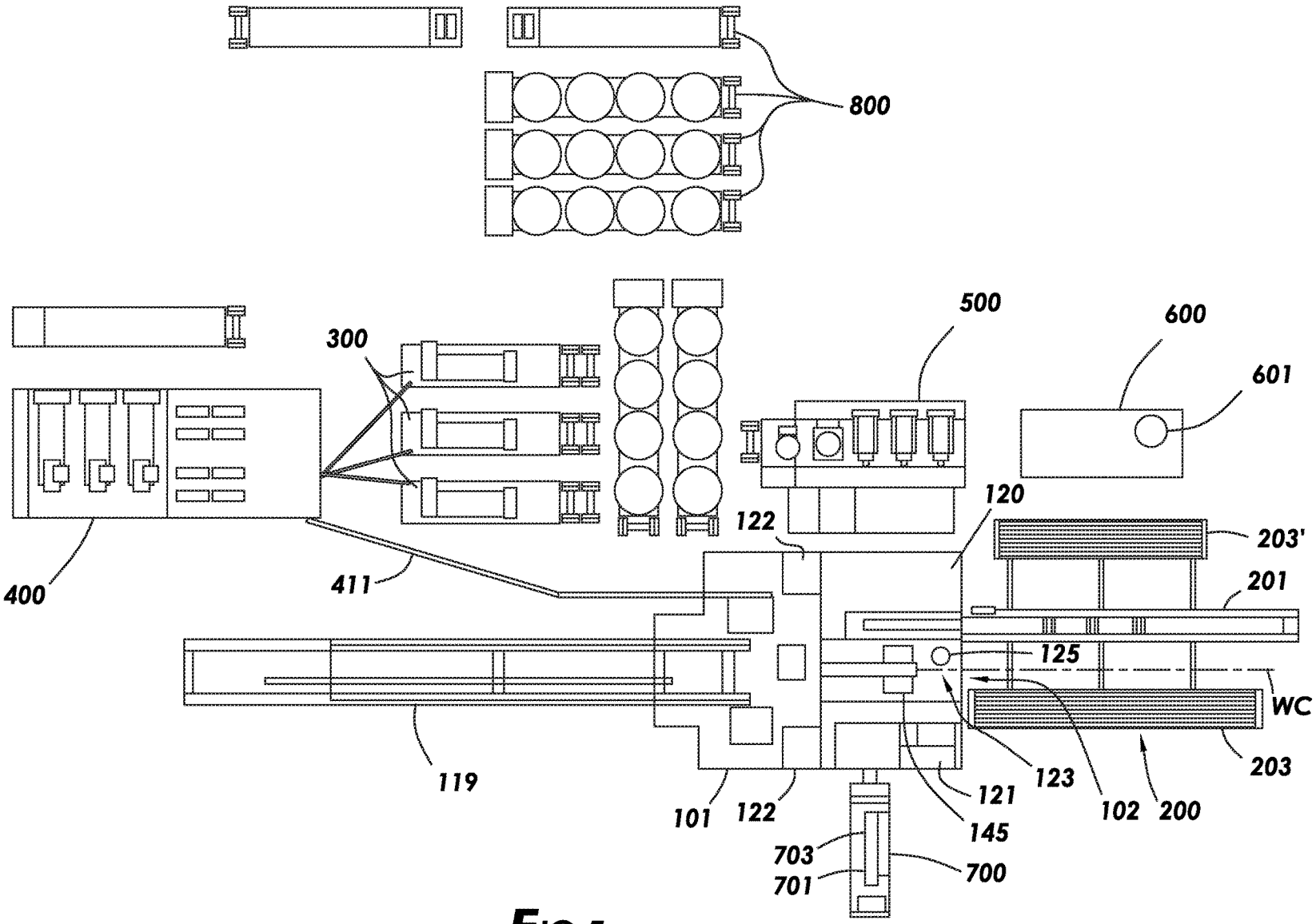
FIG. 5 depicts a top layout view of the automated drilling rig system of FIGS. 1-4.

In some embodiments, drilling rig 100 may include mast 119. Mast 119 may include a plurality of upright structures that define a frame for mast 119. Mast 119 may be positioned above a well being drilled by drilling rig 100 and may be used to support tubular members such as a drilling string being used during a drilling operation. Mast 119 may additionally be used to support other components and other tubular members during operations other than drilling operations. Mast 119 may be mechanically coupled to rig floor 101. In some embodiments, mast 119 may be pivotably coupled to rig floor 101 such that, as depicted in FIG. 5, mast 119 may be lowered to a horizontal position to, for example and without limitation, allow transportation of mast 119. In some embodiments, drilling rig 100 may include additional components including, for example and without limitation, driller's cabin 121, VFD house 120, and one or more stair towers 122. VFD house 120 may, for example and without limitation, house and protect one or more components including a variable frequency drive used to provide electrical power and control to components of drilling rig 100 that use electric motors to operate. Stair towers 122 may be structures coupled to drilling rig 100 that provide access between the ground level and rig floor 101 when rig floor 101 is in the raised operational position.

In some embodiments, drilling rig 100 may include pipe handling apparatus 123. Pipe handling apparatus 123 may include column 125, pipe handler 127, pipe handler arm 131, and pipe handler carriage 133. Pipe handling apparatus 123 may, for example and without limitation, be used to transfer tubular members (such as tubular member 30 as shown in FIG. 7) from catwalk system 200 to an operable location within mast 119 as further discussed herein below. Tubular members 30 may be any tubular member for use with drilling rig 100 including, for example and without limitation, drill pipe, casing, collars, pipe stands, casing stands, or other tubular members. In some embodiments, pipe handling apparatus 123 may include column 125. Column 125 may be mechanically coupled to rig floor 101 and may be selectively rotatable relative thereto. Column 125 may provide a structure for supporting pipe handler 127 above rig floor 101 and may at least partially facilitate the movement of pipe handler 127 relative to rig floor 101. In some embodiments, pipe handling apparatus 123 may include pipe handler 127, which may be used to engage and move a tubular member between locations on drilling rig 100 during operations of drilling rig 100. Specifically, pipe handler 127 may be used to engage and move the tubular member from catwalk system 200 to a position above the well such that the tubular member may be placed into the well by other components of drilling rig 100. Pipe handler 127 may include one or more grippers 129 adapted to grip onto a tubular member. In some embodiments, grippers 129 may be used to rotate the tubular member. In some embodiments, pipe handler 127 may include pipe handler arm 131 adapted to, for example and without limitation, allow pipe handler 127 to modulate the position and angle of a tubular member being held by pipe handler 127. Pipe handler 127 may be coupled to column 125 by pipe handler carriage 133. Pipe handler carriage 133 may be operatively coupled to column 125 such that pipe handler carriage 133 may move vertically relative to column 125. Pipe handler carriage 133 may, for example and without limitation, allow pipe handler 127 to move a tubular segment vertically.

Figure 8:
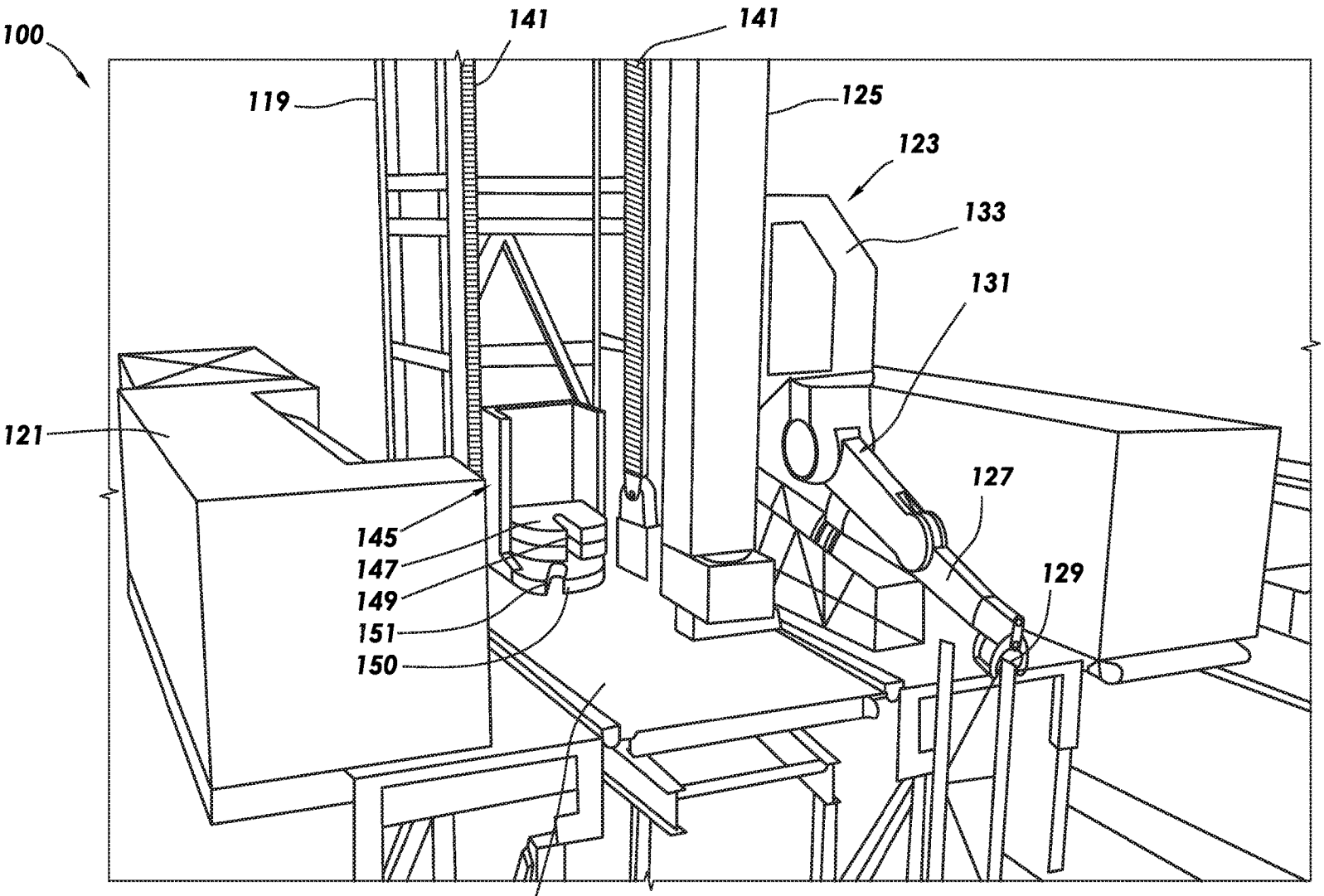
FIG. 8 depicts a perspective view of a drilling rig consistent with at least one embodiment of the present disclosure.
Figure 19:
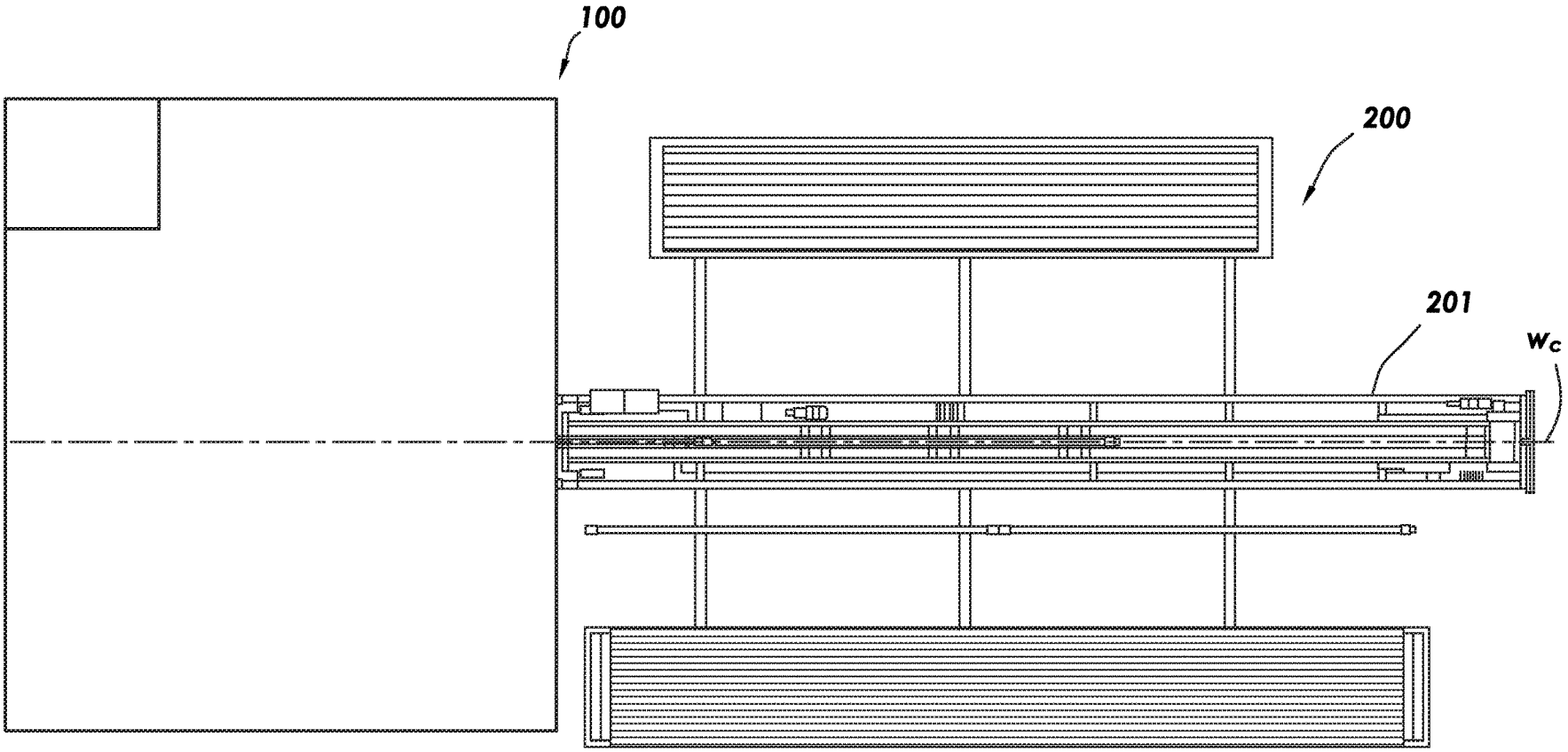
FIG. 19 depicts a top view of a drilling rig and catwalk system consistent with at least one embodiment of the present disclosure.
Figure 19A:
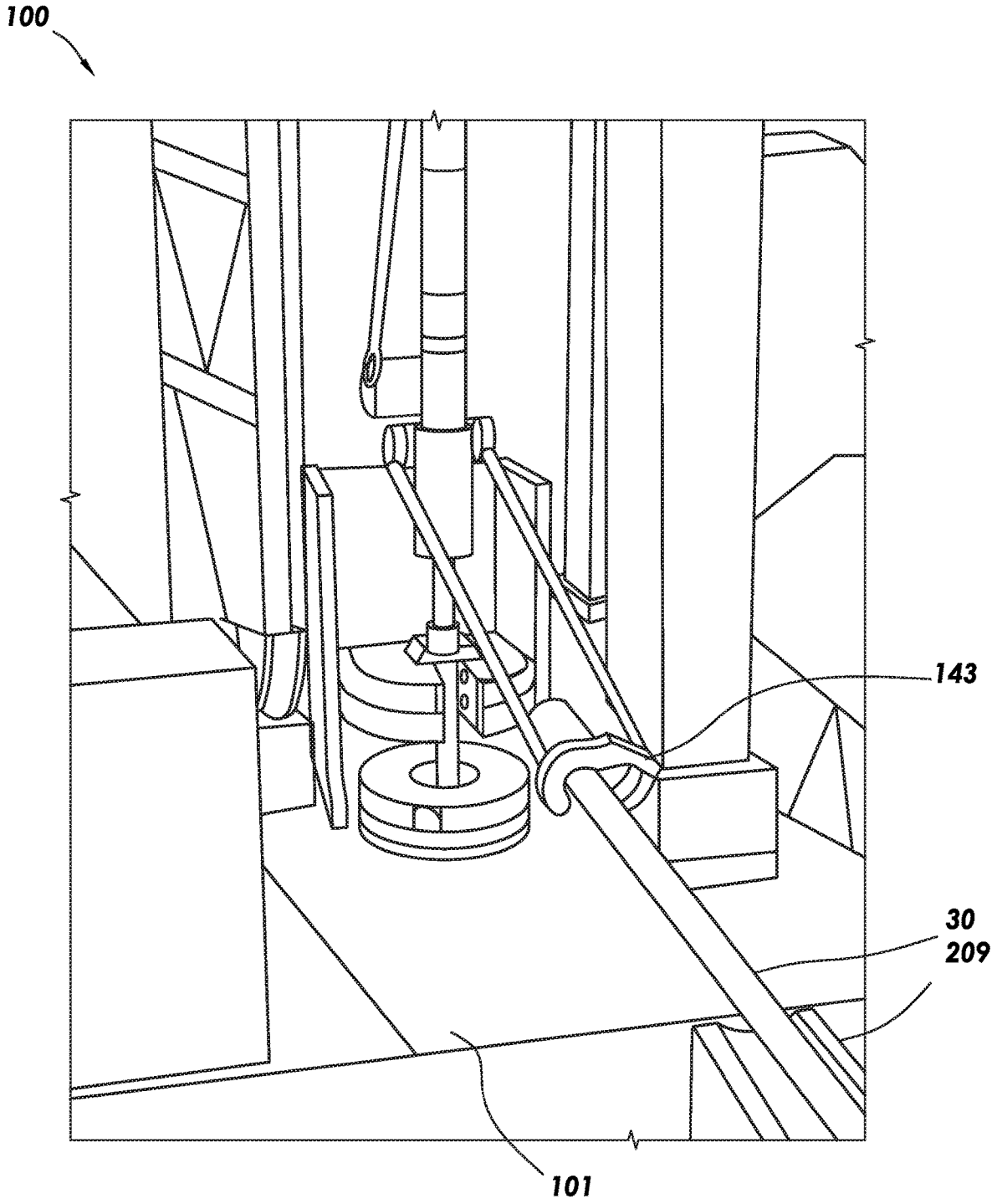
FIG. 19A depicts a detailed perspective view of the drilling rig of FIG. 19.

In some embodiments, as shown in FIGS. 5, 8, and 19A, pipe handling apparatus 123 may be positioned on rig floor 101 such that column 125 is offset from the front of mast 119 at the well drilling rig 100 is being used with, denoted by well centerline Wc. Such an arrangement may allow access between the side of rig floor 101 at which tubular members are introduced to rig floor 101, defining V-door side 102 of rig floor 101, and mast 119 without any obstruction above rig floor 101. Operation of pipe handling apparatus 123 is described further herein below.

In some embodiments, as depicted in FIG. 7, drilling rig 100 may include top drive 135. Top drive 135 may be mechanically coupled to mast 119 such that top drive 135 may move vertically relative to mast 119. Top drive 135 may be used to raise, lower, and rotate tubular members during operation of drilling rig 100. In some embodiments, top drive 135 may be raised and lowered by a cable and drawworks assembly. In some embodiments, top drive 135 may be raised and lowered by rack and pinion carriage 137. Rack and pinion carriage 137 may include one or more motors coupled to and driving corresponding pinions 139. Pinions 139 may engage with one or more corresponding racks 141 coupled vertically to mast 119. By raising or lowering rack and pinion carriage 137, top drive 135 may be raised or lowered along mast 119 relative to rig floor 101.

In some embodiments, top drive 135 may include circulator 136 positioned to allow drilling fluid to be circulated through a drill string during a drilling operation. Circulator 136 may be a tubular member adapted to fit into a tubular member of a drill string and seal thereagainst. Drilling fluid may be pumped through circulator 136 and into the drill string for use during a drilling operation.

In some embodiments, drilling rig 100 may include pipe elevator 143. Pipe elevator 143 may include one or more components that engage to a tubular member. In some embodiments, pipe elevator 143 may include one or more hinged parts adapted to close about the outer diameter of the tubular member below an upset in the tubular member, such as the increase in diameter at the top joint of the tubular member. Pipe elevator 143 may support and lift the tubular member by abutting the upset of the pipe joint. Pipe elevator 143 may be used, for example and without limitation, to raise or lower tubular members used by drilling rig 100. Pipe elevator 143 may be coupled to top drive 135 such that pipe elevator 143 moves with top drive 135.

Figure 9:
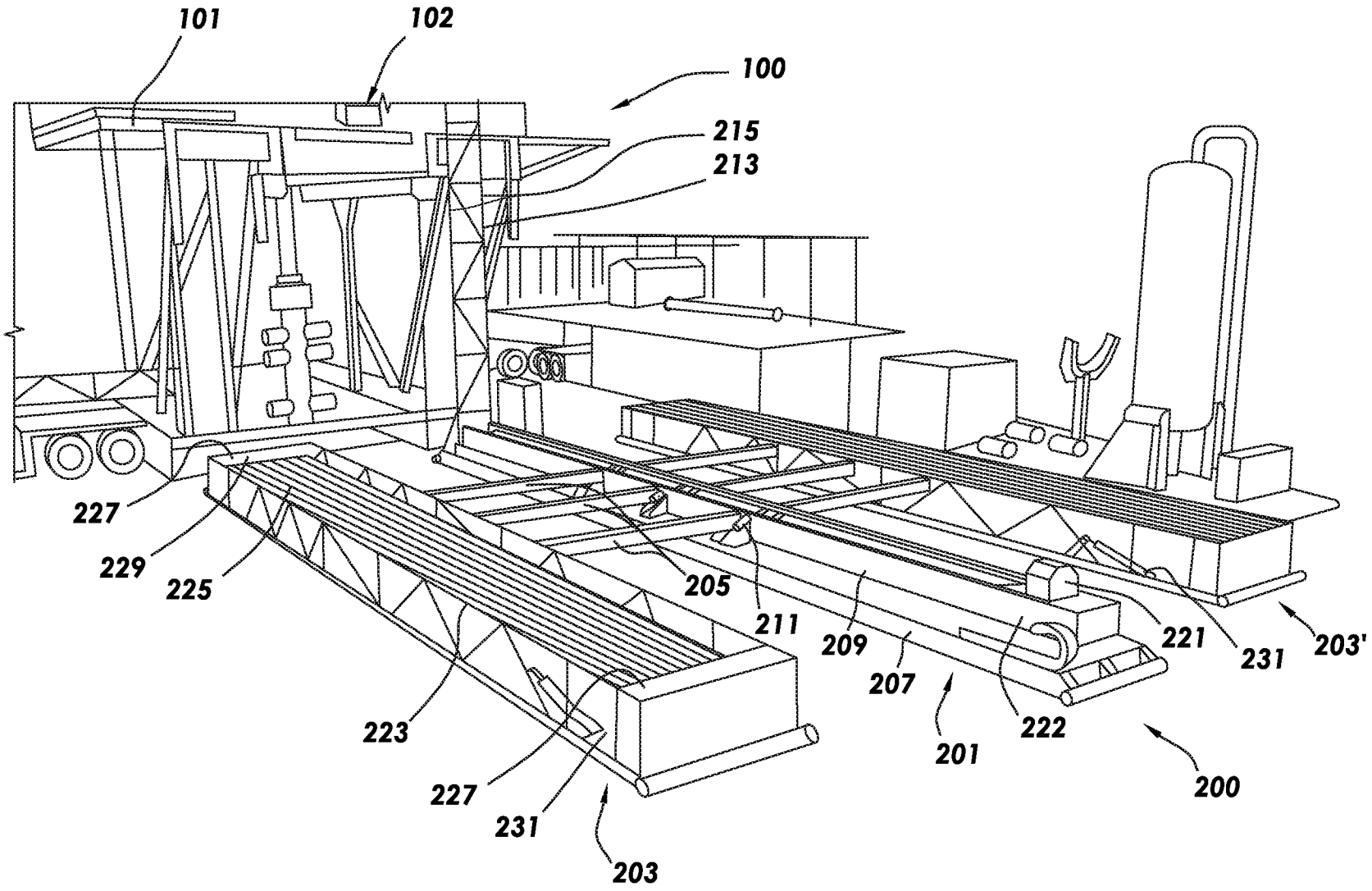
FIG. 9 depicts a perspective view of a catwalk system consistent with at least one embodiment of the present disclosure.
Figure 18:
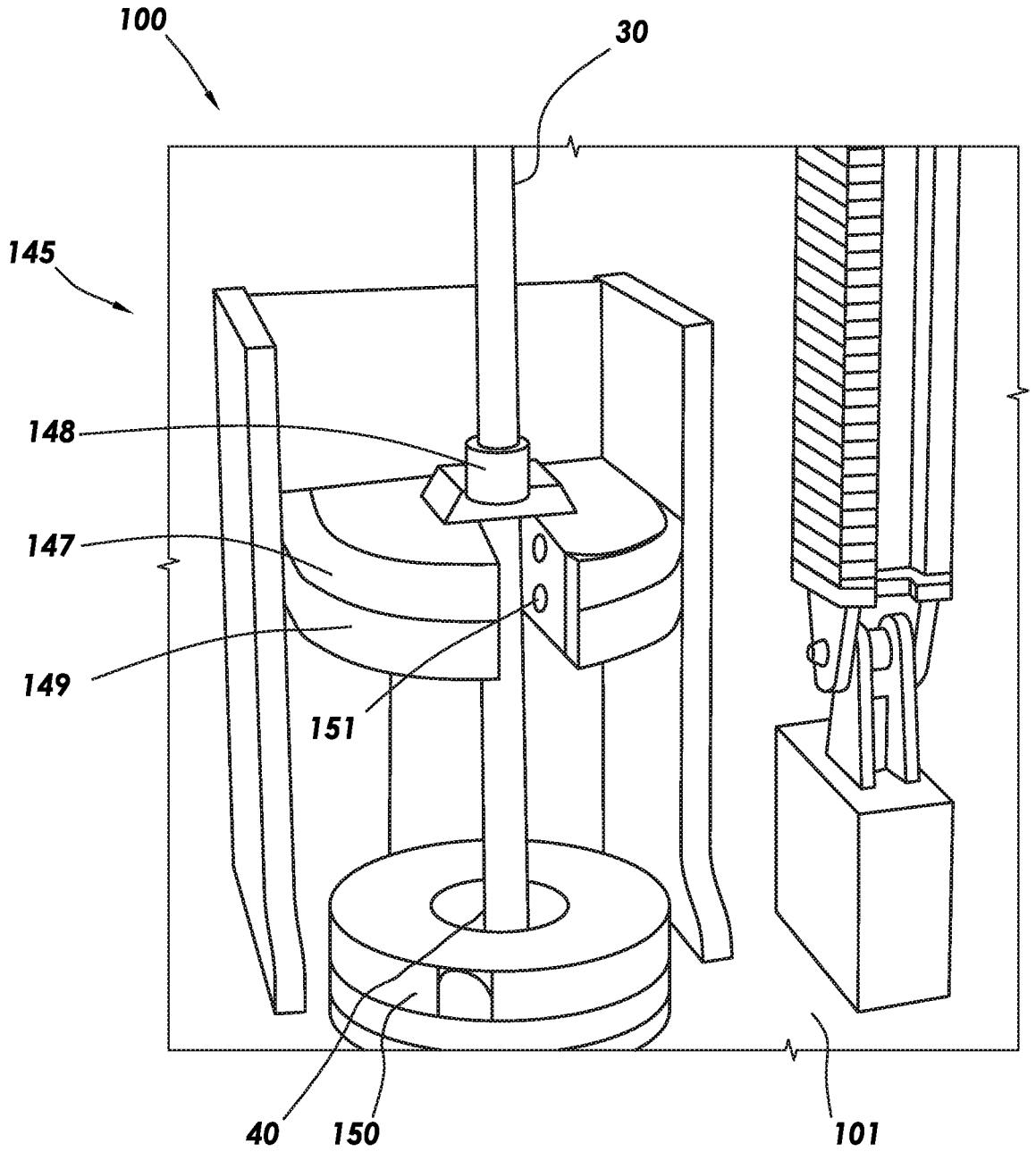
FIG. 18 depicts a perspective view of an automated roughneck of a drilling rig consistent with at least one embodiment of the present disclosure.

In some embodiments, as depicted for example in FIGS. 8 and 18, drilling rig 100 may include automated roughneck 145. Automated roughneck 145 may be used, as described further below, to make-up or break-out threaded connections between tubular segments used by drilling rig 100. Automated roughneck 145 may include make-up tong 147 and backup tong 149. In some embodiments, make-up tong 147 and backup tong 149 may each include one or more grippers 151 positioned to grip onto a tubular member when automated roughneck 145 is used to make-up or break-out a threaded connection. In some embodiments, make-up tong 147 may be adapted to rotate relative to backup tong 149 as further described below. In some embodiments, automated roughneck 145 may include stabbing guide 148. Stabbing guide 148 may be positioned on the upper surface of make-up tong 147 and may be used to assist in the alignment between tubular members being made up by automated roughneck 145 as further discussed below. Stabbing guide 148 may include one or more guide plates that may move between an inactive position and an actuated position. In some embodiments, automated roughneck 145 may include automated pipe slips 150 positioned to support the weight of a drill string In some embodiments, as shown in FIG. 9, automated drilling rig system 10 may include catwalk system 200. Catwalk system 200 may, in some embodiments, include catwalk assembly 201 and one or more pipe tubs 203. Catwalk system 200 may be used to transport tubular members from ground level to the level of rig floor 101 as further described below. In some embodiments, pipe tubs 203 may be mechanically coupled to catwalk assembly 201 by one or more struts 205. In some embodiments, struts 205 may be pivotably coupled to catwalk assembly 201 and pipe tubs 203 such that pipe tubs 203 may be pivoted into a position alongside catwalk assembly 201 for transportation of catwalk system 200.

Figure 9A:
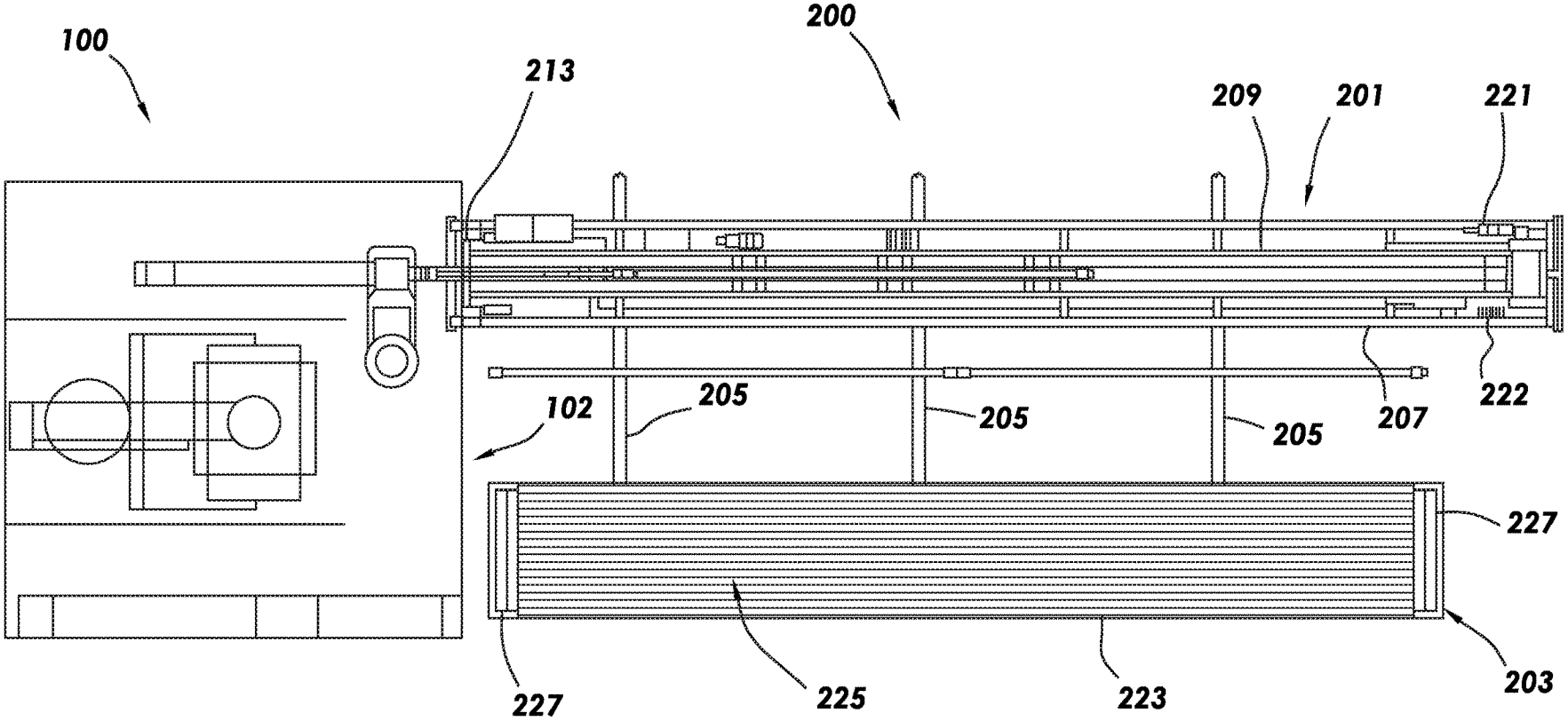
FIG. 9A is a top view of the catwalk system of FIG. 9.

In some embodiments, catwalk assembly 201 may include base 207 and catwalk slide 209. Catwalk slide 209 may be adapted to receive a tubular member from pipe tubs 203 and transport the tubular member from ground level to the level of rig floor 101 at V-door side 102 of rig floor 101. Catwalk assembly 201 may include one or more indexing arms 211 positioned to selectively allow tubular members to enter catwalk slide 209 one at a time as further described below. In some embodiments, as shown in FIG. 9A, catwalk assembly 201 may be positioned offset from well centerline Wc such that catwalk assembly 201 is not aligned mast 119. Such an arrangement may allow catwalk assembly 201 to move tubular member 30 at least partially above rig floor 101 beside mast 119 and to an extent not allowable if catwalk assembly 201 were aligned with mast 119.

In some embodiments, catwalk system 200 may include catwalk lift frame 213. Catwalk lift frame 213 may include one or more upright members that are mechanically coupled between catwalk assembly 201 and rig floor 101. Catwalk lift frame 213 may be mechanically coupled to base 207 of catwalk assembly 201. Catwalk slide 209 may mechanically couple to catwalk lift frame 213 at the end of catwalk slide 209 proximate drilling rig 100 such that the end of catwalk slide 209 proximate drilling rig 100 may slide along catwalk lift frame 213. In some embodiments, catwalk lift frame 213 may include racks 215 running vertically along catwalk lift frame 213. Catwalk slide 209 may include one or more motors coupled to one or more corresponding pinions 217 (shown in FIG. 9C) such that the end of catwalk slide 209 may traverse up and down along catwalk lift frame 213 during operation of catwalk system 200 as further described below. In some embodiments, catwalk lift frame 213 may be pivotably coupled to base 207 of catwalk assembly 201 such that catwalk lift frame 213 may be lowered to a horizontal position, for example and without limitation, for transport of catwalk system 200.

Figure 9B:
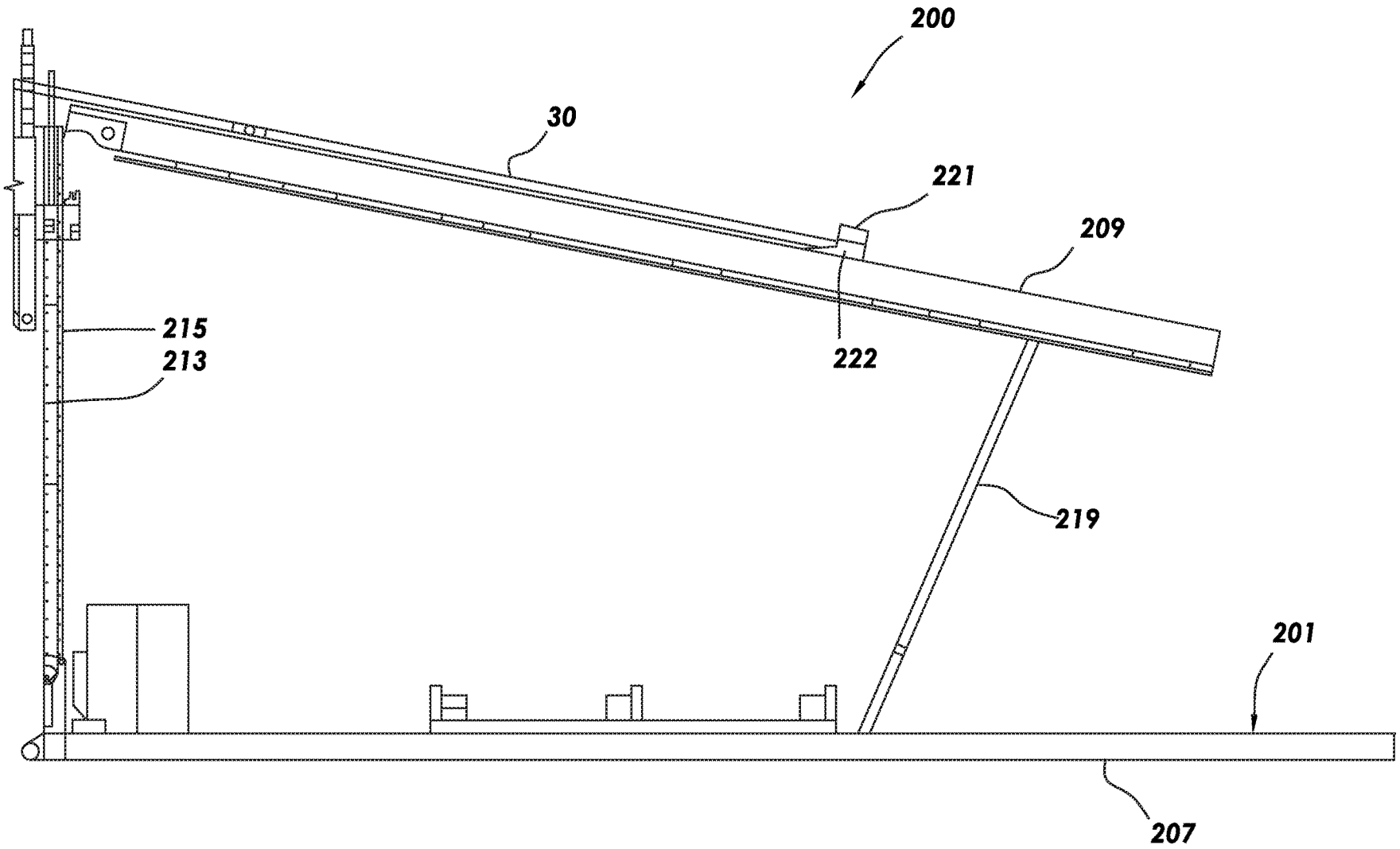
FIG. 9B is a side view of the catwalk system of FIG. 9.
Figure 9C:
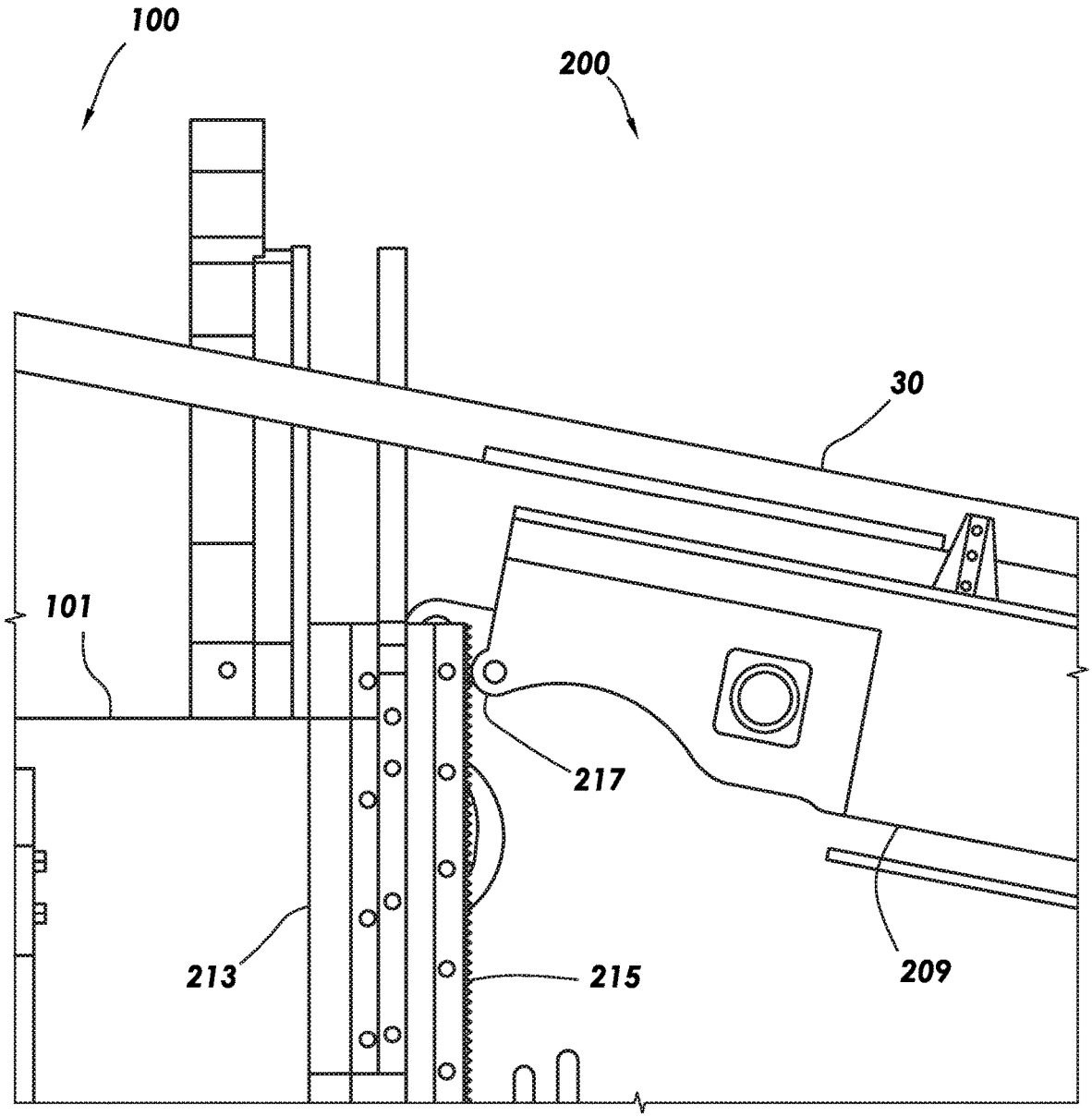
FIG. 9C is a detail side view of the catwalk system and drilling rig of FIG. 9.

In some embodiments, the end of catwalk slide 209 distal to drilling rig 100 may be adapted to slide relative to base 207 of catwalk assembly 201. In some embodiments, as depicted in FIG. 9B, catwalk slide 209 may be mechanically coupled to base 207 of catwalk assembly 201 by leveling strut 219. Leveling strut 219 may be pivotably coupled to base 207 and pivotably coupled to catwalk slide 209 such that as the end of catwalk slide 209 proximal to drilling rig 100 travels up along catwalk lift frame 213, leveling strut 219 raises the end of catwalk slide 209 distal to drilling rig 100 such that catwalk slide 209 is at a smaller inclination than an embodiment in which the distal end of catwalk slide 209 remains at ground level. In some embodiments, for example and without limitation, by reducing the inclination of catwalk slide 209 when in the raised position, the end of a tubular member held by catwalk slide 209 and introduced to drilling rig 100, such as tubular member 30 shown in FIG. 7, the height of the end of tubular member 30 above rig floor 101 may be reduced.

In some embodiments, catwalk system 200 may include skate 221. Skate 221 may be a structure slidingly coupled to catwalk slide 209 and movable relative thereto that is used to position and move tubular member 30 along catwalk slide 209. Skate 221 may engage with the lower end of tubular member 30 and may be used to move tubular member 30 longitudinally along catwalk slide 209. Skate 221 may, for example and without limitation, be used to introduce tubular member 30 to drilling rig 100 when catwalk slide 209 is in the raised position. In some embodiments, skate 221 may be coupled to position sensor 222 such that the position of skate 221, and therefore the lower end of tubular member 30, is known.

Figure 10:
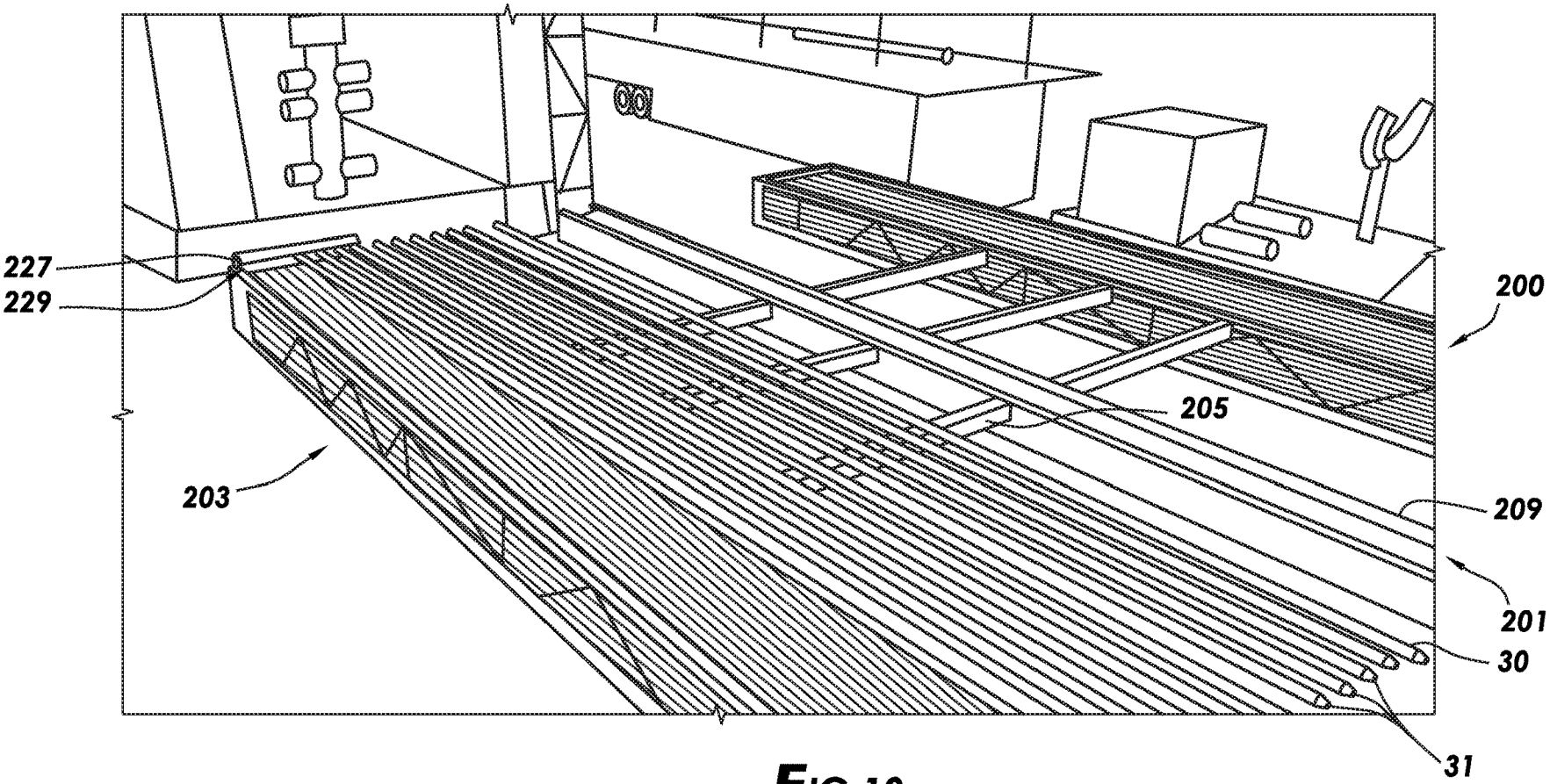
FIG. 10 depicts a perspective view of the catwalk system of FIG. 9 during operation.

In some embodiments, pipe tubs 203 may be storage containers used to store tubular members not yet being used by drilling rig 100 within catwalk system 200. Pipe tubs 203 may be configured to store and subsequently provide tubular members to catwalk assembly 201 for use in drilling rig 100 as discussed below. In some embodiments, pipe tubs 203 may also be used to transport tubular members stored therein. In some embodiments, pipe tubs 203 may include frame 223. Frame 223 may define tubular storage area 225 used for storing tubular members 31 as shown in FIG. 10. In some embodiments, pipe tubs 203 may include one or more support frames 227. Support frames 227 may be coupled to frame 223 such that support frames 227 may be raised or lowered relative to frame 223. In some embodiments, each support frame 227 may include one or more channels 229. Channels 229 may be substantially horizontal to the ground or may be angled such that the end of channels 229 nearest catwalk assembly 201 is lower than the outside end of channels 229. In some embodiments, the ends of tubular members 31 stored within pipe tub 203 may be positioned within channels 229. Support frames 227 may allow tubular members 31 stored within pipe tub 203 to be stored in multiple layers. When tubular member 31 are to be transferred to catwalk assembly 201 to be used with drilling rig 100, support frames 227 may be raised such that the uppermost layer of tubular members 31 is at or above the level of the top side of frame 223. Once above the top of frame 223, tubular members 31 may roll along channels 229 and catwalk struts 205. In some embodiments, channels 229 and catwalk struts 205 may be tilted to allow tubular members 31 to roll by gravity toward catwalk assembly 201.

Figure 24:
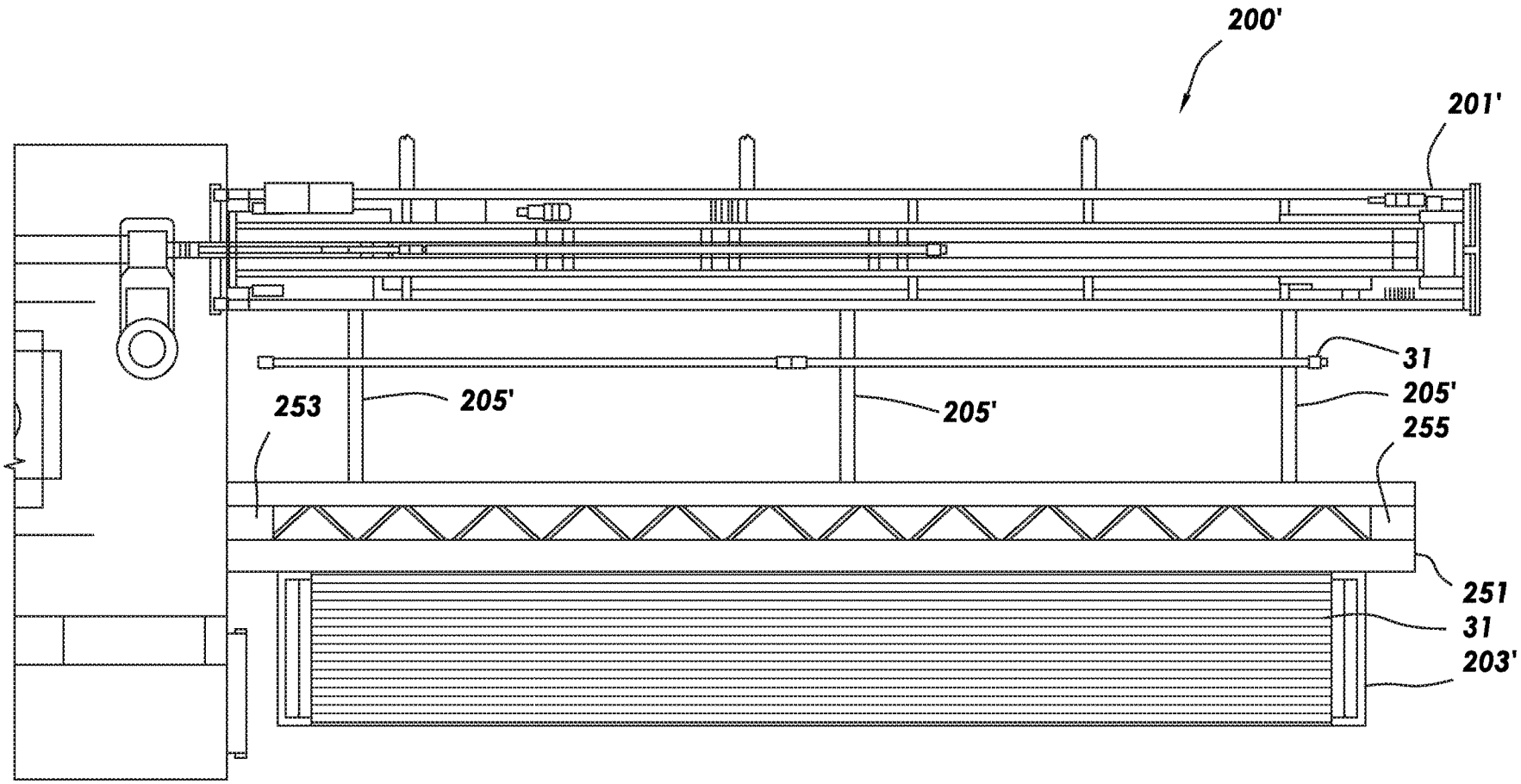
FIG. 24 depicts a top layout view of a catwalk system of an automated drilling rig system consistent with at least one embodiment of the present disclosure.

In some embodiments, as depicted in FIG. 24, catwalk system 200' may include pipe doping skid 251. Pipe doping skid 251 may be positioned between pipe tub 203' and catwalk assembly 201'. Pipe doping skid 251 may include one or more automated doping assemblies such as, for example and without limitation, upper pipe doper 253 and lower pipe doper 255. In some embodiments, as tubular members 31 roll from pipe tub 203' to catwalk assembly 201', upper pipe doper 253 and/or lower pipe doper 255 may engage each tubular member 31 and apply pipe dope to the upper and lower joints thereof respectively. Once doped, tubular member 31 may be positioned onto catwalk struts 205' to continue to catwalk assembly 201' as discussed above with respect to catwalk system 200.

Figure 11A:
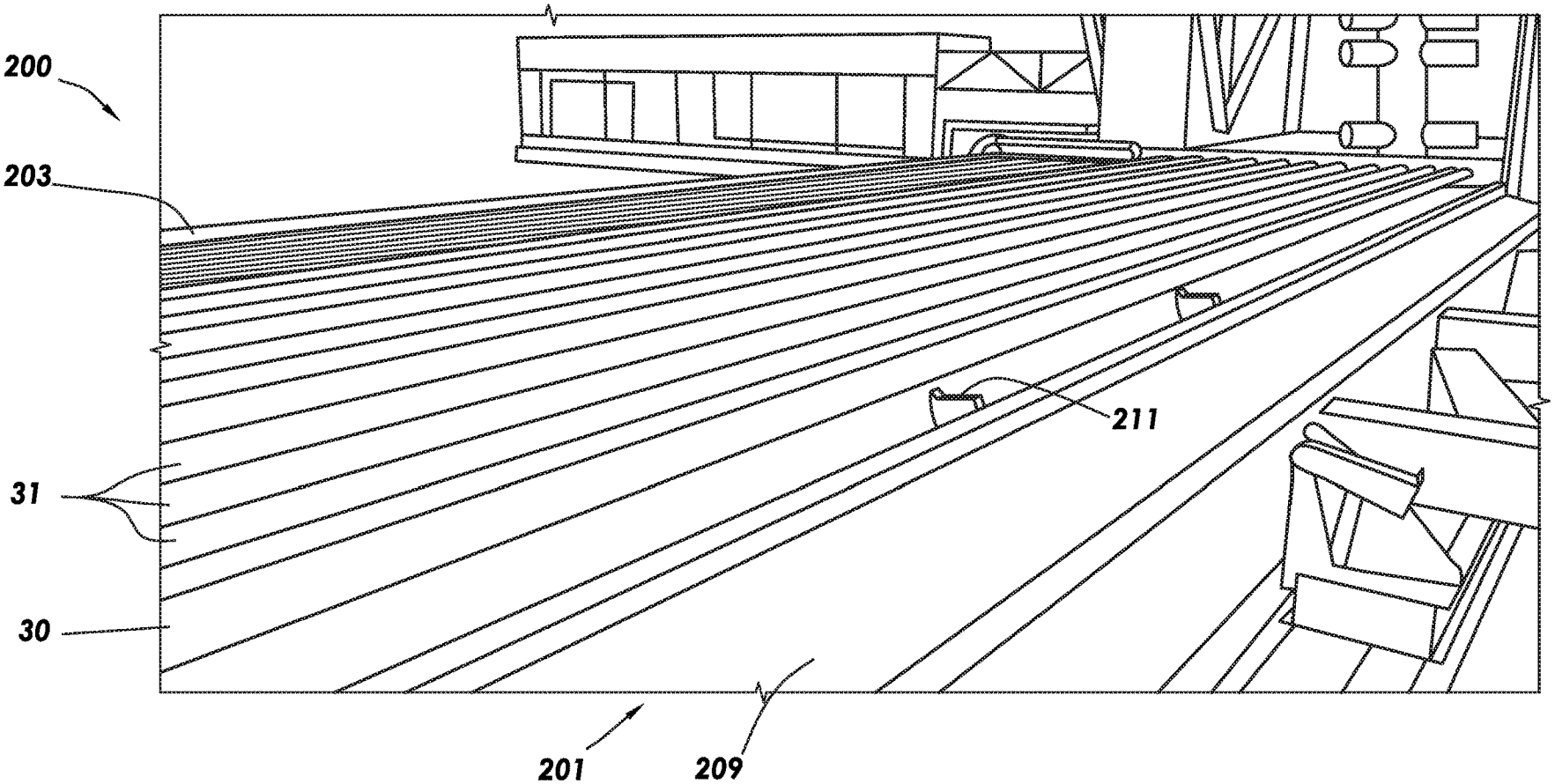
FIGS. 11A-C depict detail perspective views of the catwalk system of FIG. 9 during operation.
Figure 11B:
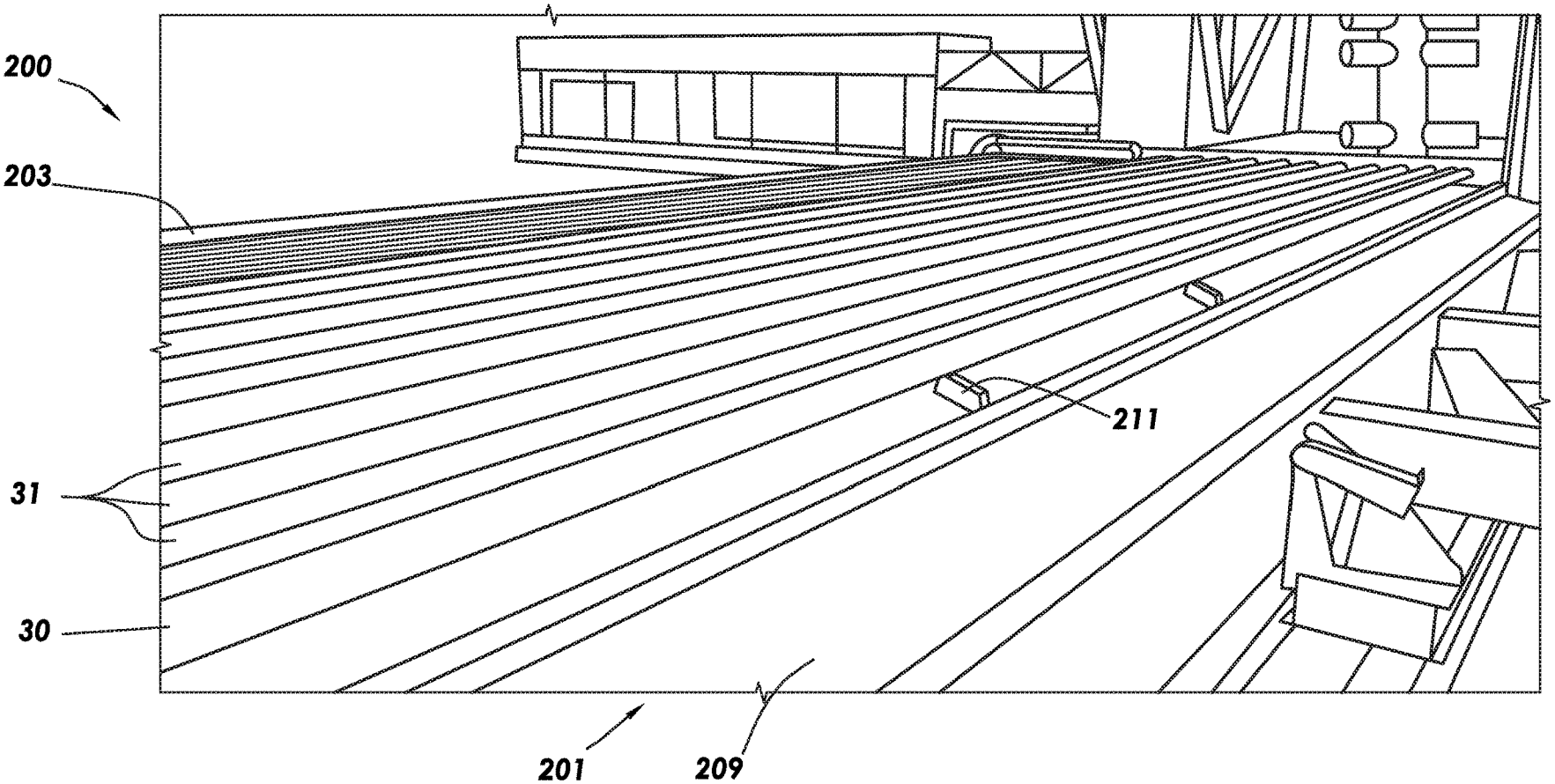
Figure 11C:
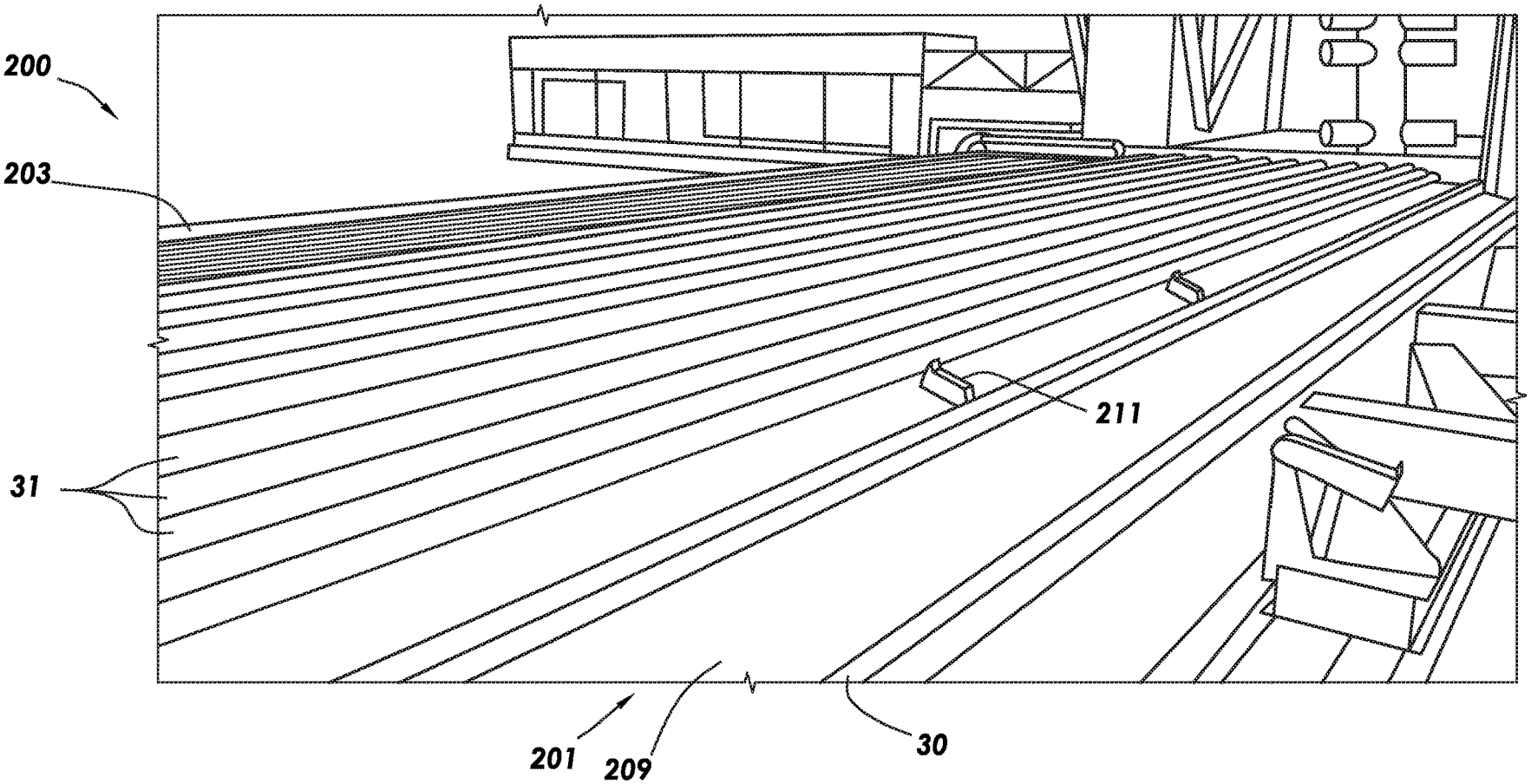

In some embodiments, the rolling of tubular members 31 may be stopped by indexing arms 211 until the positioning of a tubular member into catwalk slide 209 is desired as shown in FIG. 11A. In some embodiments, indexing arms 211 may hold the foremost tubular member, denoted tubular member 30, at a standby position. Indexing arms 211 may then lower as shown in FIG. 11B to allow tubular member 30 to pass over indexing arms 211. As tubular member 30 passes indexing arms 211, indexing arms 211 may raise again to prevent further tubular members 31 from passing indexing arms 211. Tubular member 30 may continue to move along indexing arms 211 and into position within catwalk slide 209 as shown in FIG. 11C.

Figure 10A:
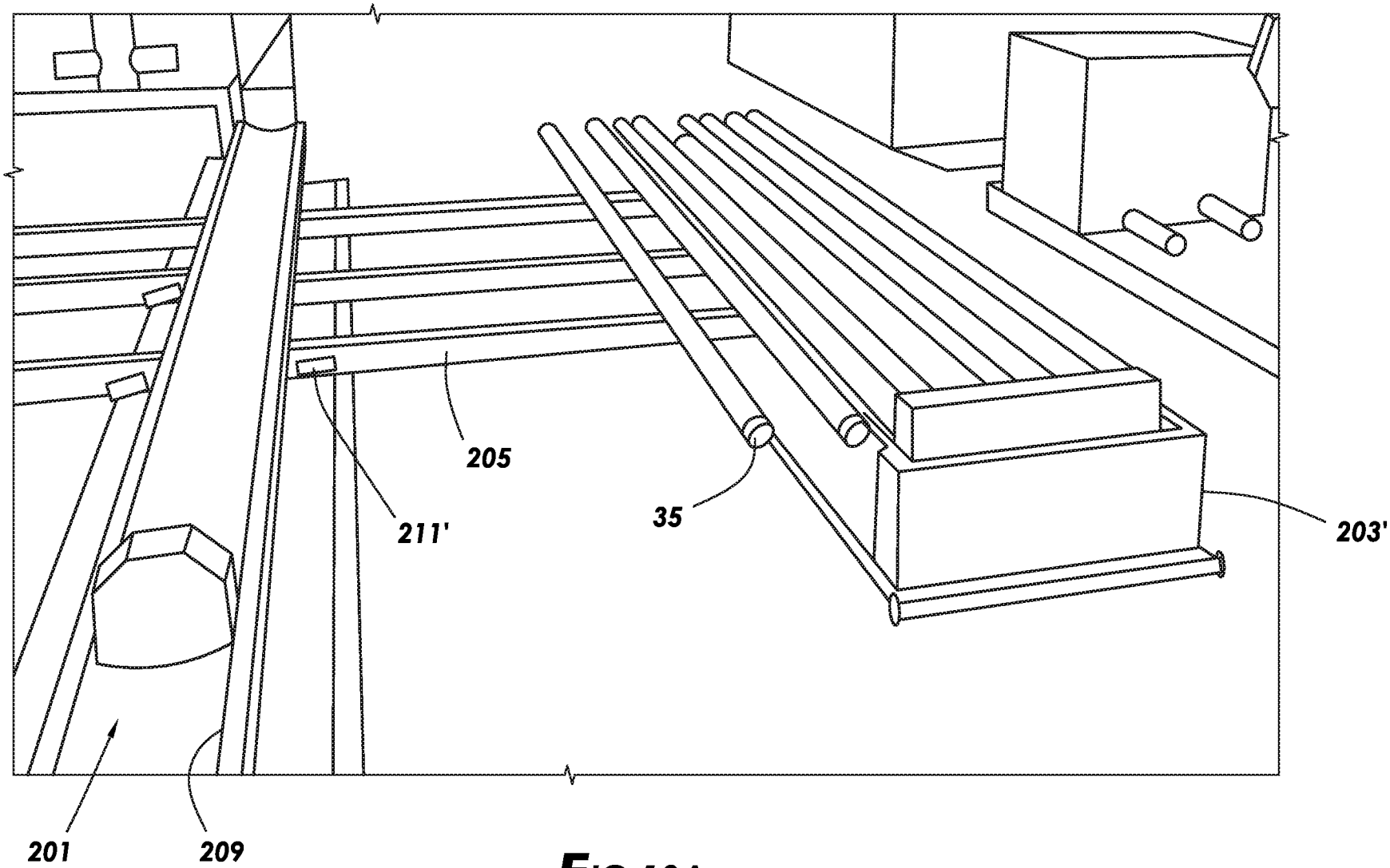
FIG. 10A depicts a perspective view of the catwalk system of FIG. 9 during operation.

In some embodiments, where two pipe tubs 203 are utilized, each pipe tub 203 may be configured to store different tubular members. For example, as shown in FIG. 10A, pipe tub 203' may be used to hold larger-diameter tubular members such as casing 35. In some embodiments, catwalk assembly 201 may include additional indexing arms 211' adapted to handle tubular members of larger diameter than indexing arms 211. Pipe tub 203' may otherwise operate to transfer casing 35 to catwalk assembly 201 substantially as tubular member 30 is transferred to catwalk assembly 201 by pipe tub 203.

In some embodiments, one or all components of catwalk system 200 may be electrically driven and controlled. In some embodiments, operation of catwalk system 200 may be controlled by a central control system of automated drilling rig system 10 such that catwalk system 200 is operable with minimal or no human interference.

Figure 12:
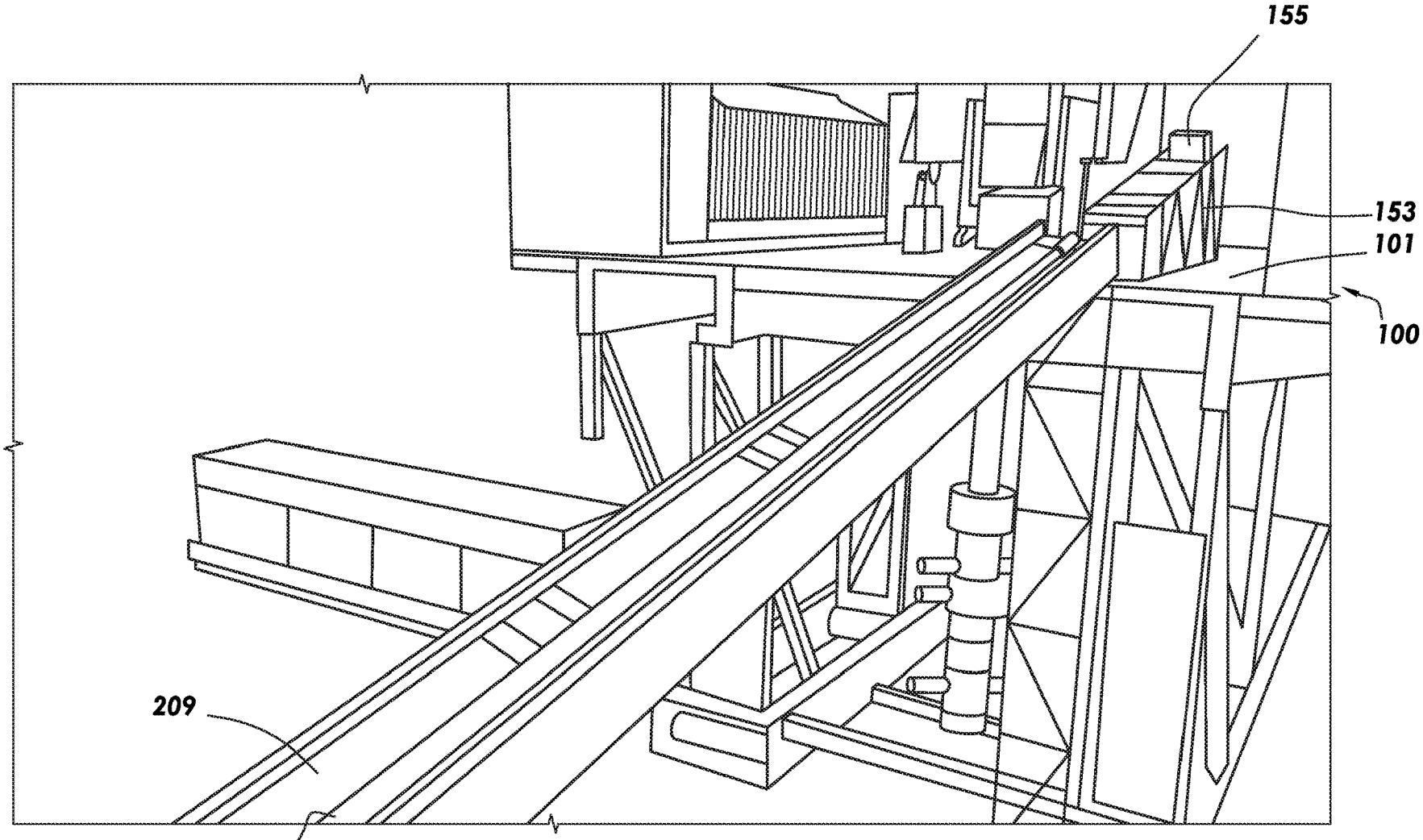
FIG. 12 depicts a pipe preparation skid of the drilling rig and a catwalk slide of the catwalk system of FIG. 9 during operation.
Figure 13:
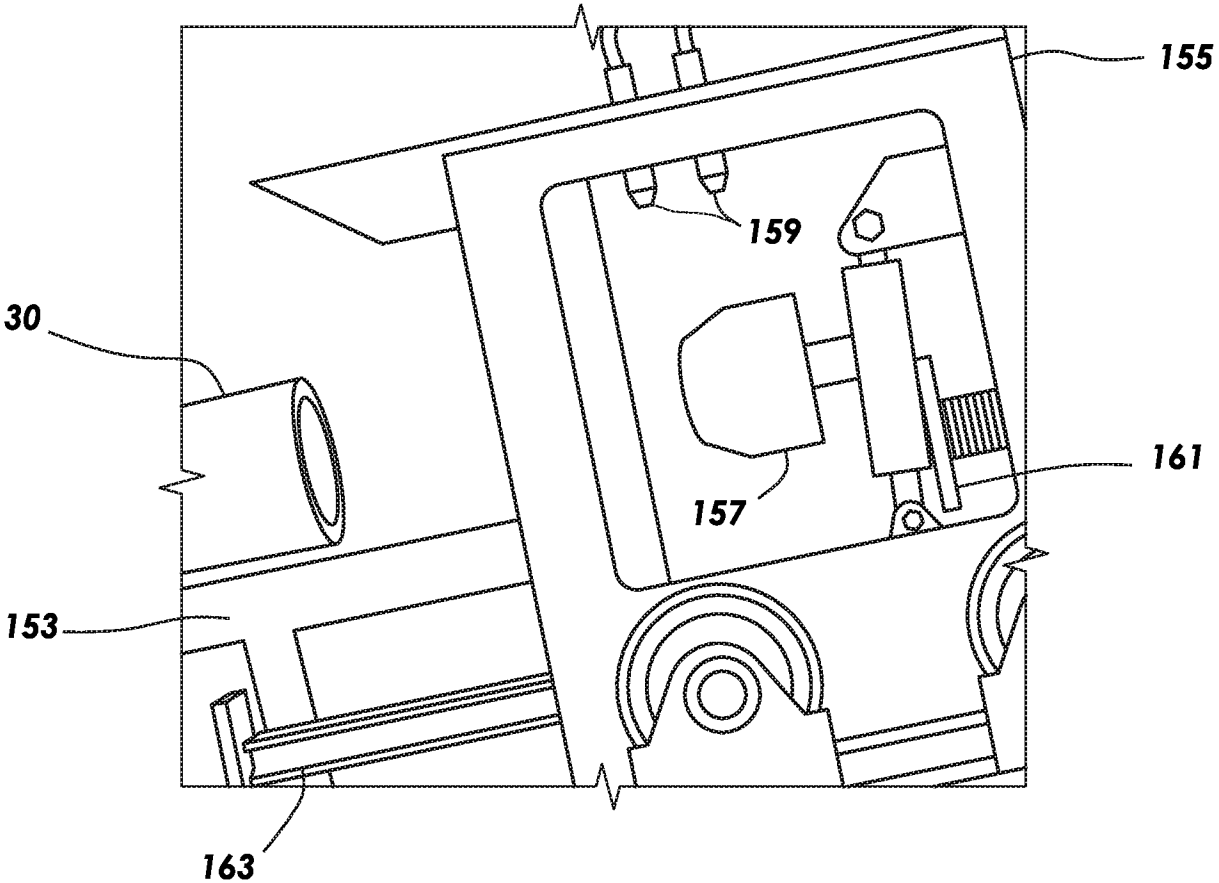
FIG. 13 depicts a cutaway detail view of a pipe doping apparatus consistent with at least one embodiment of the present disclosure.
Figure 13A:
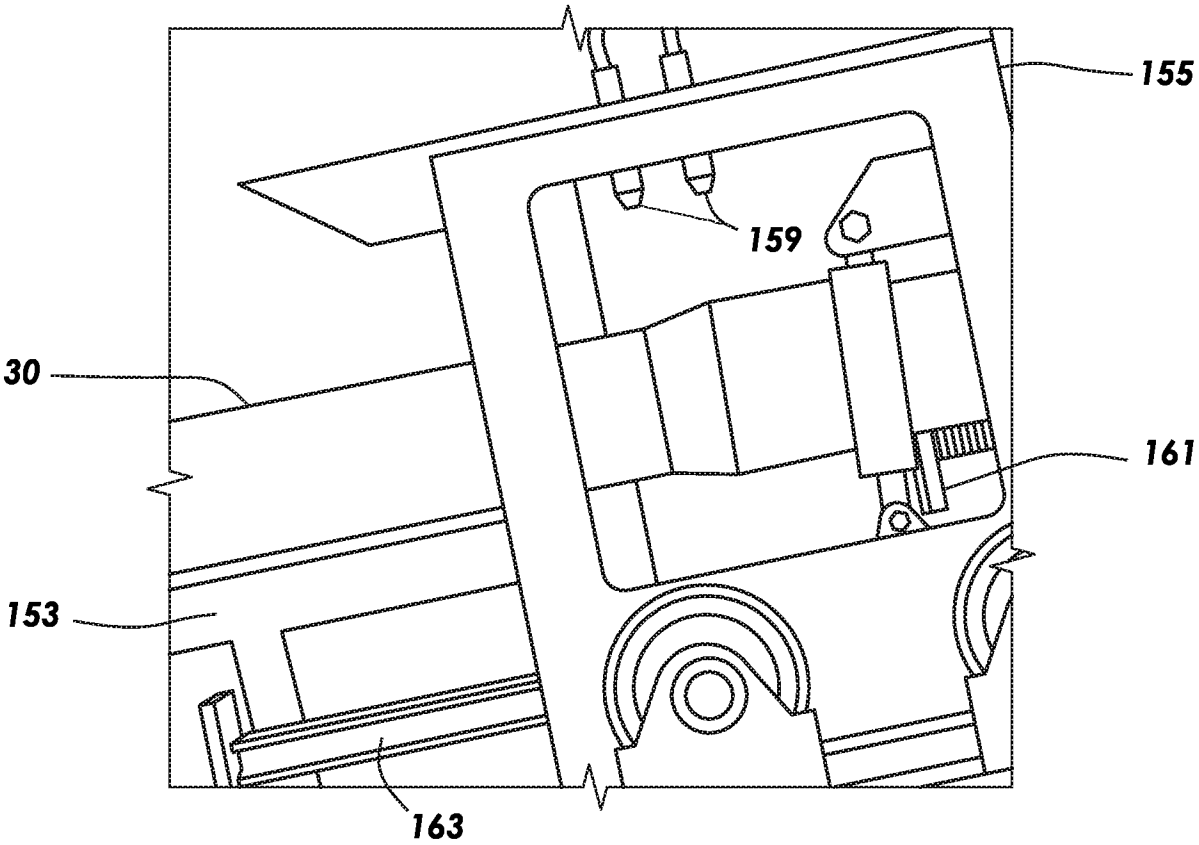
FIG. 13A depicts the pipe doping apparatus of FIG. 13 in operation.

Once positioned within catwalk slide 209, catwalk slide 209 may move to the raised position depicted in FIG. 9B. Skate 221 may advance tubular member 30 along catwalk slide 209. In some embodiments, as depicted in FIG. 12, tubular member 30 may be advanced into pipe preparation skid 153 positioned on rig floor 101. Pipe preparation skid 153 may, in some embodiments, at least partially support tubular member 30 above rig floor 101. In some embodiments, pipe preparation skid 153 may include top-end doping apparatus 155. Top-end doping apparatus 155, as shown in FIG. 13, may be used to apply pipe dope to the female or box-end threaded coupler of tubular member 30. In some embodiments, top-end doping apparatus 155 may include dope brush 157. Dope brush 157 may be sized such that dope brush 157 fits within the box-end threaded coupler of a range of sizes of tubular members to be used with drilling rig 100. In some embodiments, top-end doping apparatus 155 may include one or more nozzles 159 positioned to apply pipe dope or any other fluid to dope brush 157 before tubular member 30 is engaged to dope brush 157. In some embodiments, once tubular member 30 is engaged to dope brush 157, as shown in FIG. 13A, dope brush 157 may be rotated such that pipe dope is evenly applied to the box-end threaded coupler of tubular member 30.

Figure 13B:
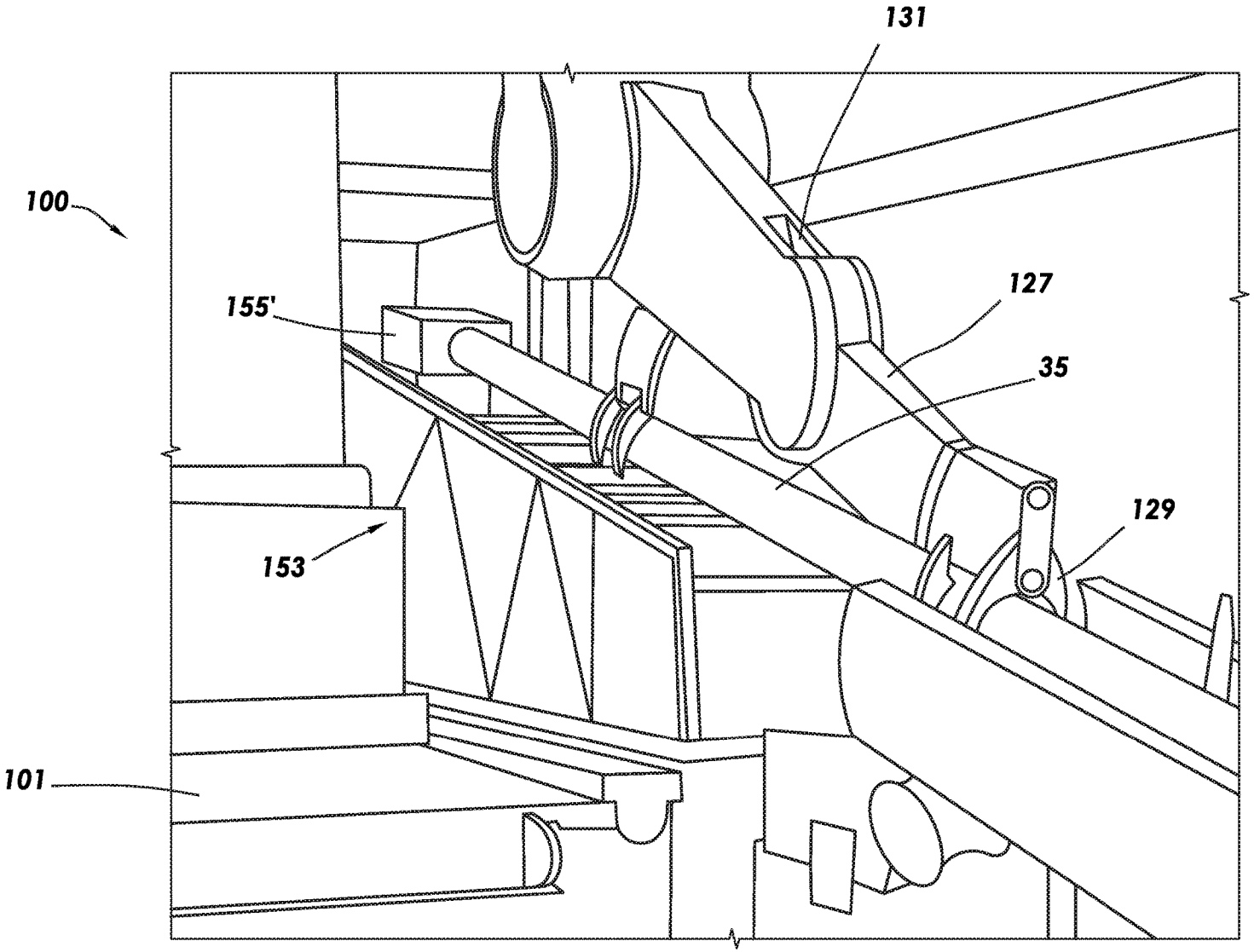
FIG. 13B depicts an alternative configuration of a pipe preparation skid consistent with at least one embodiment of the present disclosure.

In some embodiments, pipe preparation skid 153 may include one or more sensors such as limit switch 161 positioned to detect that tubular member 30 is at a desired position. For example, in some embodiments as depicted in FIG. 13A, the desired position may be positioned where tubular member 30 is fully inserted into top-end doping apparatus 155. In other embodiments, as depicted in FIG. 13B, pipe preparation skid 153 may include stop plate 155' positioned to stop a tubular member (shown as casing 35) from advancing further along pipe preparation skid 153 at the desired position. By knowing that tubular member 30 is positioned at the desired position and by knowing the position of the lower end of tubular member 30 using position sensor 222, the length of tubular member 30 may be measured and logged. In some embodiments, by logging the length of each tubular member 30 added to a drill string, the length of the drill string may be more accurately known compared to an embodiment in which nominal pipe length values are used.

In some embodiments, pipe preparation skid 153 may include one or more pipe profile sensors 163 positioned to determine the profile of tubular member 30 as tubular member 30 is transported onto pipe preparation skid 153. Profile, as used herein, may include the dimensions of tubular member 30 including, for example and without limitation, diameter of pipe, diameter of tool joint upset, length of tool joint upset, and type of tool joint. By knowing the profile of tubular member 30, the specific specifications of tubular member 30 may be determined. Pipe profile sensors 163 may, for example and without limitation, be positioned to detect the upset corresponding with the box-end tool joint of tubular member 30. In some embodiments, the length of the box-end tool joint of tubular member 30 may thereby be determined, and the profile of tubular member 30 may be determined based on known tubular profile parameters. In some embodiments, pipe profile sensors 163 may operate in combination with limit switch 161.

In some embodiments, where top-end doping apparatus 155 is used and tubular member 30 is measured, if desired, tubular member 30 may be retracted from top-end doping apparatus 155 such that tubular member 30 can be moved vertically away from pipe preparation skid 153 by pipe handling apparatus 123.

Figure 14:
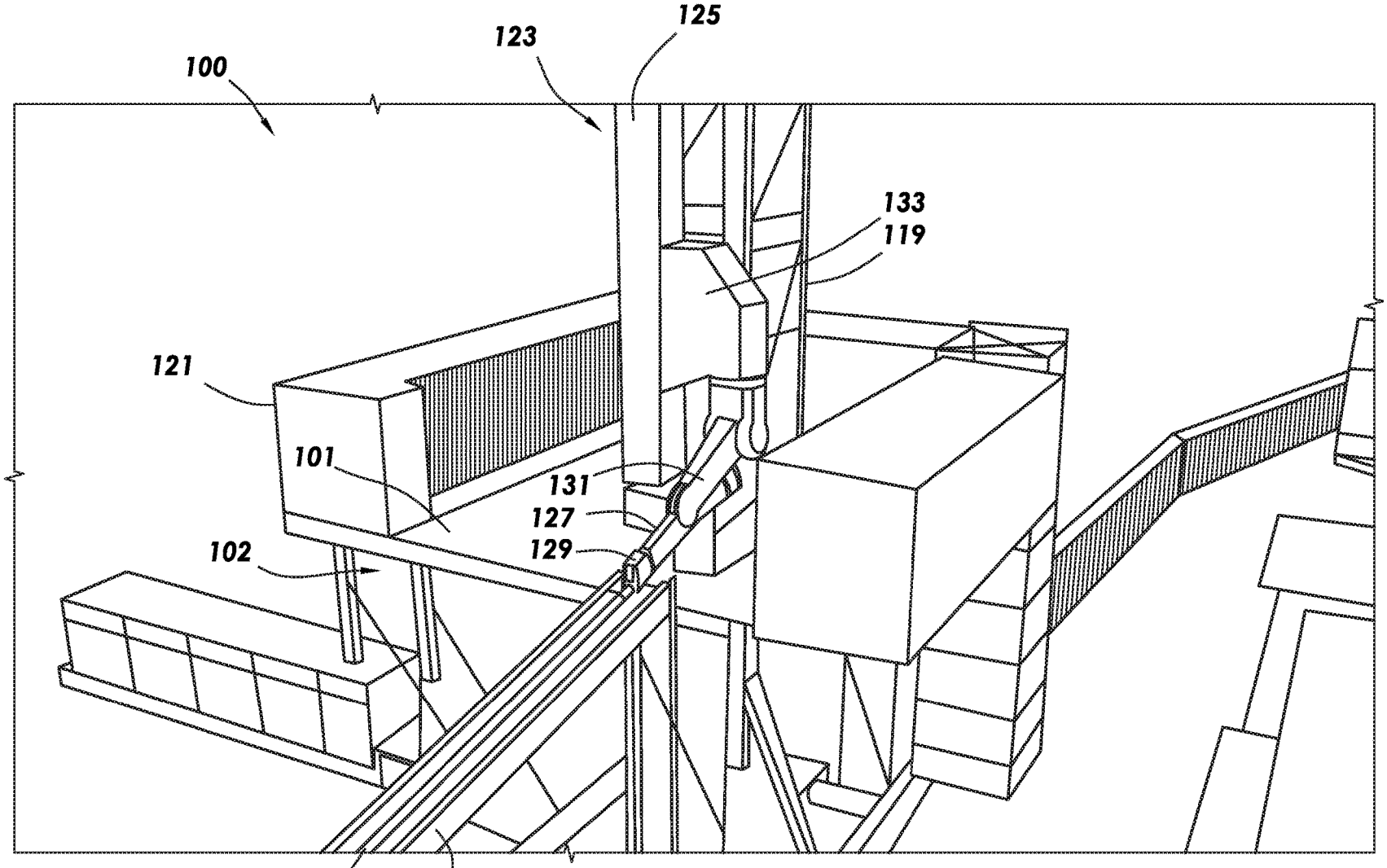
FIG. 14 depicts a pipe handling apparatus, catwalk slide, and drilling rig consistent with at least one embodiment of the present disclosure.

In some embodiments, pipe handling apparatus 123 may lower pipe handler 127 to the level of tubular member 30 as shown in FIG. 14. Pipe handler arm 131 may rotate pipe handler 127 to a more horizontal position such that grippers 129 may engage and grip onto tubular member 30. In some embodiments, by positioning tubular member 30 onto pipe preparation skid 153 and therefore extending over rig floor 101, pipe handler 127 may be able to grip onto tubular member 30 at a location closer to the center of mass of tubular member 30, thereby reducing bending stress on tubular member 30 and torsional loading on pipe handling apparatus 123 relative to gipping tubular member 30 nearer to the box-end in an embodiment where tubular member 30 does not extend over rig floor 101.

Figure 15:
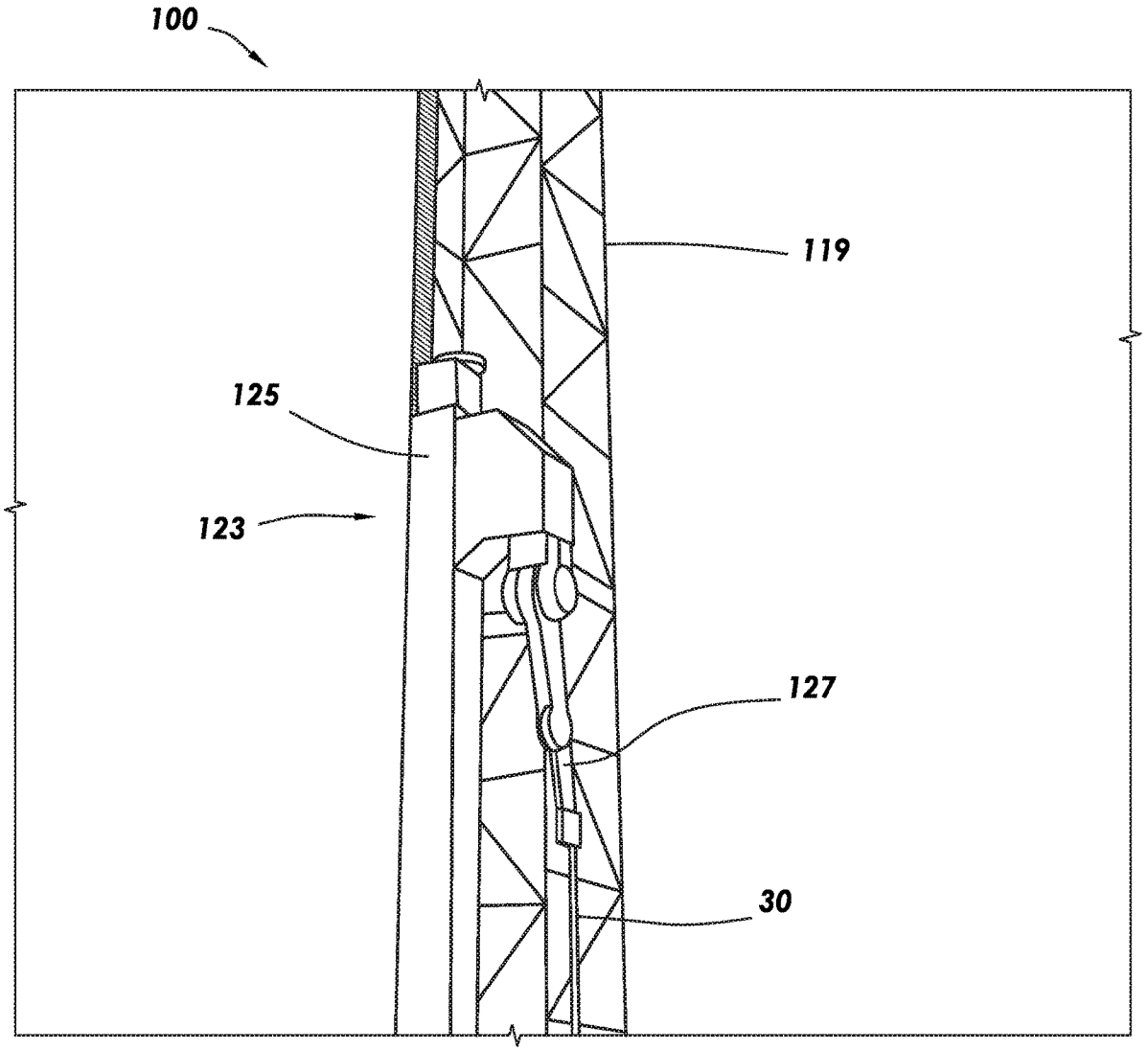
FIG. 15 depicts the pipe handling apparatus and drilling rig of FIG. 14 in an alternate position.

Once pipe handler 127 grips onto tubular member 30, pipe handling apparatus 123 may lift tubular member 30 into a substantially vertical position as depicted in FIG. 15. In some embodiments, pipe handling apparatus 123 may simultaneously raise pipe handler 127 using pipe handler carriage 133 and rotate pipe handler 127 using pipe handler arm 131 to allow tubular member 30 to move to the substantially vertical position.

Figure 16A:
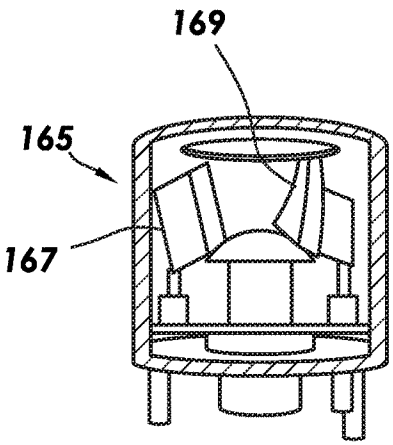
FIG. 16A depicts a cutaway view of the pipe doping apparatus of FIG. 16.
Figure 16:
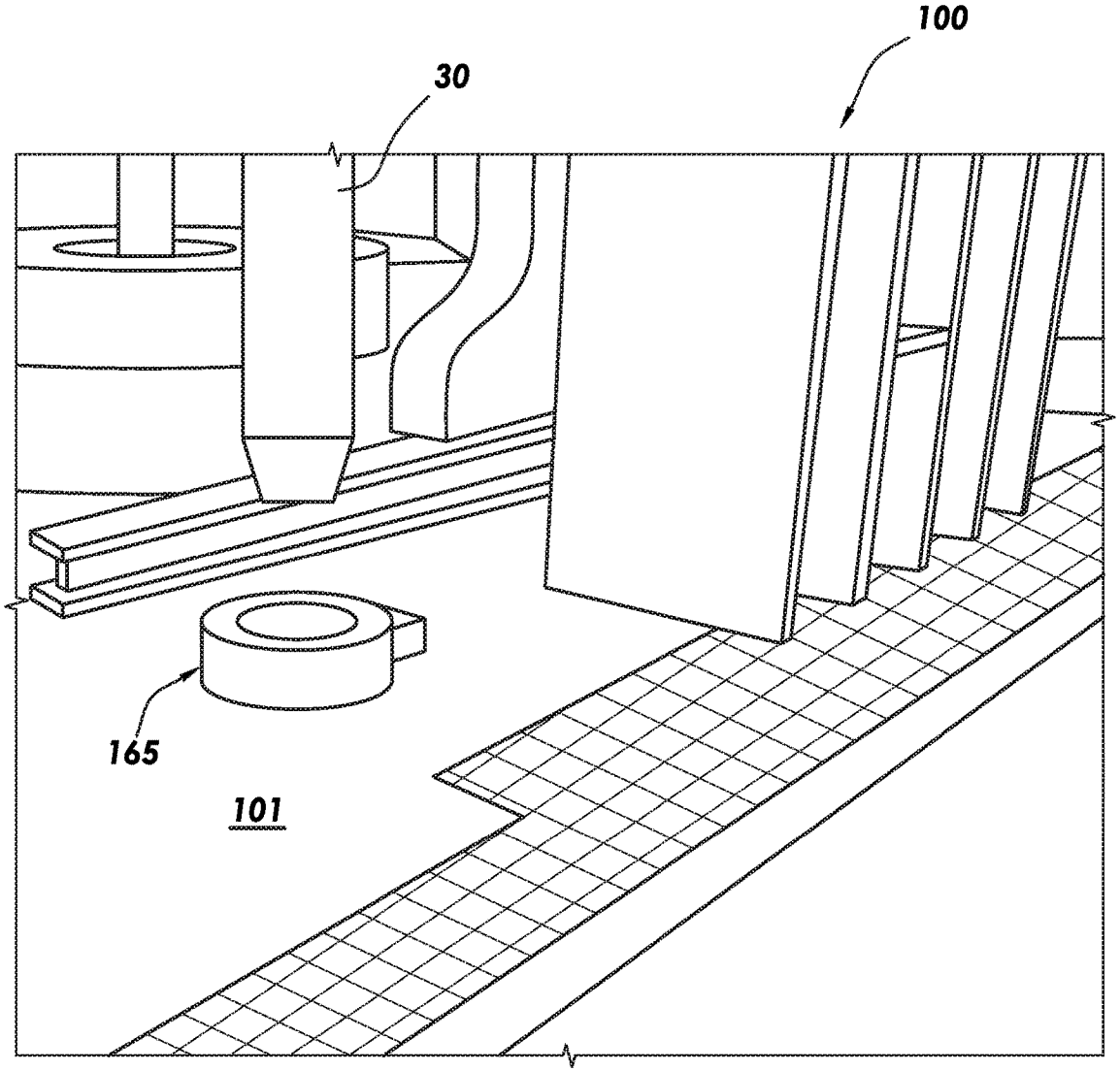
FIG. 16 depicts a perspective view of a pipe doping apparatus on the rig floor of a drilling rig consistent with at least one embodiment of the present disclosure.

In some embodiments, drilling rig 100 may include lower pin end doping apparatus 165. As shown in FIG. 16, lower pin end doping apparatus 165 may be positioned on rig floor 101 at a position between pipe preparation skid 153 and automated roughneck 145. As shown in FIG. 16A, lower pin end doping apparatus 165 may be recessed into rig floor 101 and may include one or more dope brushes 167. Dope brushes 167 may be positioned to correspond with the expected profile of the pin-end of tubular member 30. Lower pin end doping apparatus 165 may include one or more dope nozzles 169 positioned to apply pipe dope or any other fluid to dope brushes 167 before tubular member 30 is positioned within lower pin end doping apparatus 165.

Figure 16B:
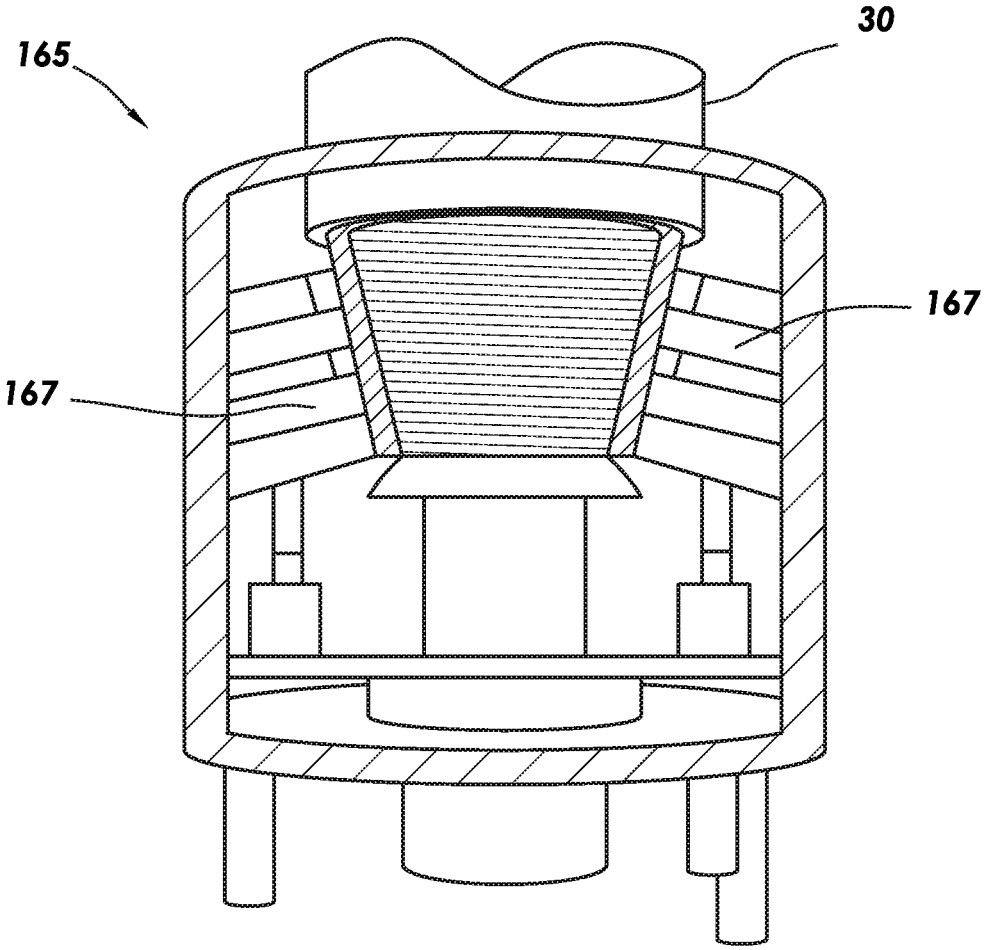
FIG. 16B depicts the pipe doping apparatus of FIG. 16A in operation.

In some embodiments, pipe handling apparatus 123 may move tubular member 30 into a position above lower pin end doping apparatus 165. Pipe handling apparatus 123 may accomplish this repositioning at least partially by rotating column 125 and by moving pipe handler arm 131. In some embodiments, pipe handling apparatus 123 may lower the pin-end of tubular member 30 into lower pin end doping apparatus 165 as shown in FIG. 16B. Dope brushes 167 may engage the pin connection of tubular member 30 as pipe handling apparatus 123 rotates tubular member 30 such that dope brushes 167 evenly apply pipe dope to the threads of tubular member 30. Once pin-end of tubular member 30 is doped, pipe handling apparatus 123 may lift tubular member 30 out of lower pin end doping apparatus 165.

Figure 17:
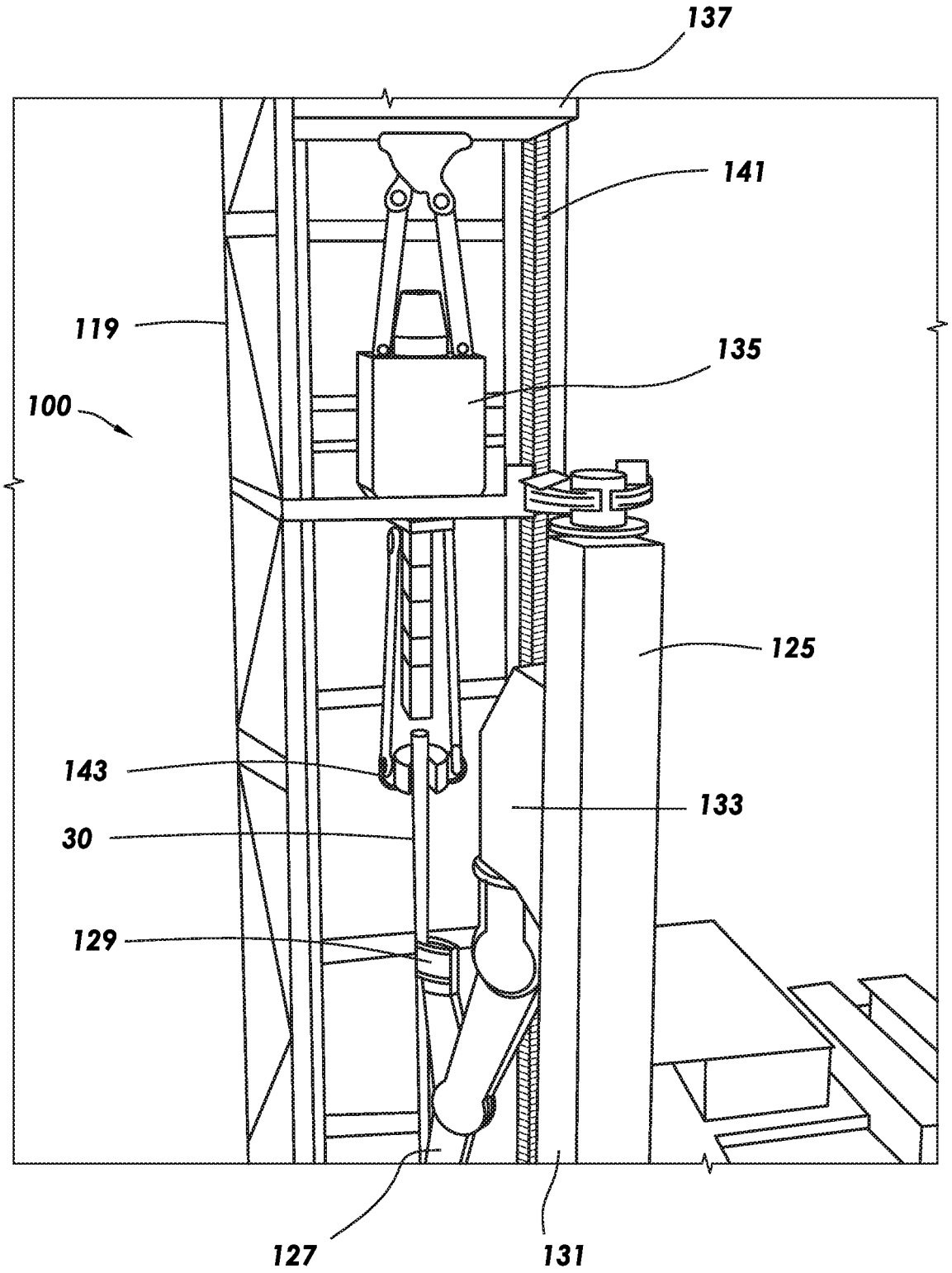
FIG. 17 depicts a perspective view of the pipe handling apparatus and drilling rig of FIG. 14 in an alternate position.

In some embodiments, pipe handling apparatus 123 may move tubular member 30 into a position above well center as shown in FIG. 17. Pipe handling apparatus 123 may accomplish this repositioning at least partially by rotating column 125 and by moving pipe handler arm 131. In some cases, such as during a trip-in operation, pipe handling apparatus 123 may position tubular member 30 within pipe elevator 143. In other cases, such as during a drilling operation, pipe handling apparatus 123 may position tubular member 30 to be operatively coupled to top drive 135 such that top drive 135 may provide rotation and fluid circulation to tubular member 30 and a drill string to which tubular member 30 is coupled.

In some embodiments, pipe handling apparatus 123 may simultaneously position the lower end of tubular member 30 within automated roughneck 145 as shown in FIG. 18. In some embodiments, such as during a trip-in operation or a drilling operation, tubular member 30 may be made up to the upper end of drill string 40. Pipe handling apparatus 123 may position tubular member 30 in line with drill string 40, which may be supported by automated pipe slips 150. In some embodiments, pipe handling apparatus 123 may lower tubular member 30 until tubular member 30 engages drill string 40. In some embodiments, stabbing guide 148 may move to the actuated position about the lower end of tubular member 30 to, for example and without limitation, guide tubular member 30 into alignment with drill string 40 as tubular member 30 is lowered. In some embodiments, pipe handling apparatus 123 may rotate tubular member 30 such that the threaded, pin-connector of tubular member 30 engages the corresponding box-connector of drill string 40. In some embodiments, tubular member 30 may be aligned with make-up tong 147 of automated roughneck 145 and drill string 40 may be aligned with backup tong 149 of automated roughneck 145. In some embodiments, make-up tong 147 and backup tong 149 may be vertically positionable relative to rig floor 101 to allow for proper alignment of make-up tong 147 and backup tong 149. In some embodiments, grippers 151 of make-up tong 147 and backup tong 149 may engage tubular member 30 and drill string 40 respectively, and make-up tong 147 may be rotated with high torque to fully engage tubular member 30 to drill string 40.

Once tubular member 30 is coupled to drill string 40 and supported by pipe elevator 143 or top drive 135, pipe handling apparatus 123 may disengage tubular member 30 and move to repeat the above-described operation with a subsequent tubular member. Automated pipe slips 150 may release drill string 40, allowing pipe elevator 143 or top drive 135 to support the weight of drill string 40. In the case of a trip-in operation, pipe elevator 143 may lower tubular member 30 and drill string 40 into the wellbore such that the operations described above may be repeated with subsequent tubular members to trip drill string 40 into the wellbore. In the case of a drilling operation, top drive 135 may rotate and lower drill string 40 to continue forming the wellbore.

In some embodiments, drilling rig 100 may be used to insert casing into the wellbore. In such an operation, drilling rig 100 and catwalk system 200 may operate substantially as described above with respect to a trip-in operation, substituting casing 35 supplied from pipe tub 203' for tubular member 30 from pipe tub 203. In some embodiments, casing 35 may or may not be doped by top-end doping apparatus 155 and/or lower pin end doping apparatus 165 during the operations.

In some embodiments, trip-out operations may be conducted substantially by reversing the order of operations of the trip-in operation described above. In some embodiments, one or both of top-end doping apparatus 155 and lower pin end doping apparatus 165 may be used to clean the top or bottom of a tubular member. In such an embodiment, one or both of top-end doping apparatus 155 and lower pin end doping apparatus 165 may include pipe cleaners such as compressed air nozzles, air blades, or brushes.

In some embodiments, operation of drilling rig 100 without the use of pipe handling apparatus 123 may be desired, such as where pipe handling apparatus 123 experiences a mechanical failure or where a tubular member of greater diameter than the capacity of pipe handling apparatus 123 is to be used. In such an embodiment, catwalk system 200 may be moved from the offset position described above and depicted in FIG. 9A to an on-center position as depicted in FIG. 19 wherein catwalk assembly 201 is aligned with well centerline Wc. In some embodiments, catwalk system 200 may include one or more systems to allow catwalk system 200 to travel between the offset and the on-center positions. For example and without limitation, in some embodiments, catwalk system 200 may include walker feet 231 (as depicted in FIG. 9) or may include one or more wheels or other transportation systems. Once catwalk system 200 is positioned in the on-center position, catwalk system 200 may operate as described above to introduce tubular member 30 to rig floor 101. However, rather than positioning tubular member 30 on pipe preparation skid 153 and using pipe handling apparatus 123 to lift tubular member 30 to the vertical position, catwalk system 200 may position the tubular member into a position accessible to pipe elevator 143 as shown in FIG. 19A such that pipe elevator 143 may be used to lift tubular member 30 to the vertical position. Such access to pipe elevator 143 may be available due to column 125 being positioned offset from well centerline Wc as described above with respect to FIG. 5.

Figure 20:
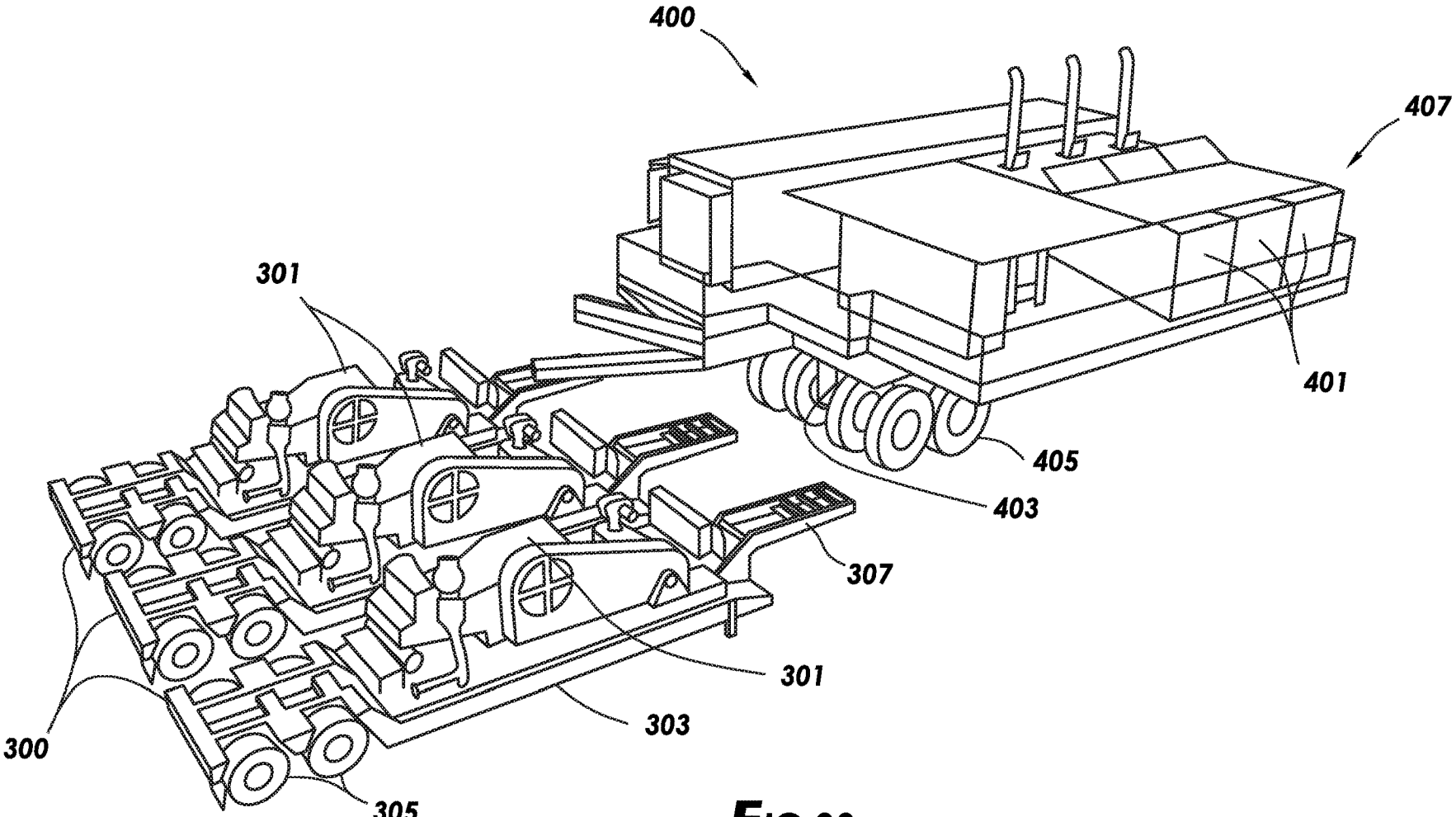
FIG. 20 depicts pump skids and a generator skid consistent with at least one embodiment of the present disclosure.

As depicted in FIGS. 1-5, automated drilling rig system 10 may, in some embodiments, include one or more pump skids 300. Pump skids 300 may be used to, for example and without limitation, provide drilling fluid to drilling rig 100 for use during operation of drilling rig 100. As shown in FIG. 20, each pump skid 300 may include mud pump 301. Mud pump 301 may, in some embodiments, be electrically powered. Mud pump 301 may be mounted on trailer 303. Trailer 303 may include one or more wheels 305 and hitch 307 positioned to allow pump skids 300 to be transported, for example and without limitation, by towing.

As depicted in FIGS. 1-5, automated drilling rig system 10 may, in some embodiments, include generator skid 400. In some embodiments, as depicted in FIG. 20, generator skid 400 may include one or more generators 401 adapted to generate electrical power for use by other components of automated drilling rig system 10. In some embodiments, generators 401 may be mounted on trailer 403. Trailer 403 may include one or more wheels 405 and hitch 407 positioned to allow generator skid 400 to be transported, for example and without limitation, by towing.

Figure 20A:
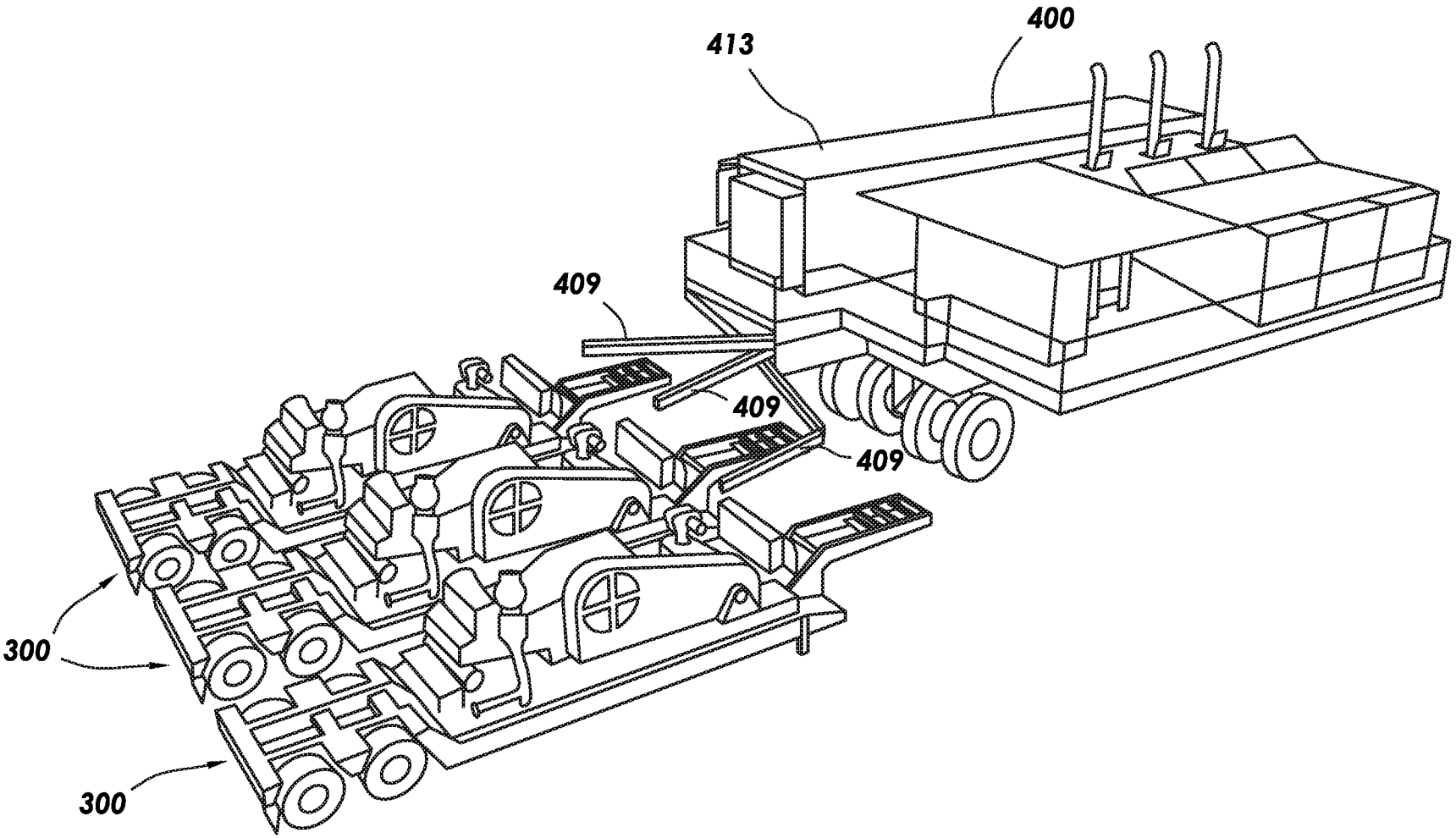
FIG. 20A depicts the pump skids and generator skid of FIG. 20 in an alternate configuration.

In some embodiments, generator skid 400 may include one or more power delivery cable arms. For example, as depicted in FIG. 20A, generator skid 400 may, in some embodiments, include pump cable arms 409. Pump cable arms 409 may be adapted to be deployed from generator skid 400 to provide electrical power to each of pump skids 300. Pump cable arms 409 may be formed from one or more cable trays that carry electrical connections to power pump skids 300. In some embodiments, generator skid 400 may include additional cable arms for providing electrical power to other components of automated drilling rig system 10. In some embodiments, as depicted in FIGS. 1-5, generator skid 400 may include rig cable arm 411. Rig cable arm 411 may be adapted to be deployed from generator skid 400 to provide electrical power to drilling rig 100. Rig cable arm 411 may, in some embodiments, be formed from one or more cable trays that carry electrical connections to power drilling rig 100. In some embodiments, pump cable arms 409 and rig cable arm 411 may be pivotably coupled to generator skid 400 such that each may be retracted during transportation of generator skid 400. In some embodiments, generator skid 400 may include power electronics 413 adapted to, for example and without limitation, control operation of generators 401 and condition power delivered to the rest of automated drilling rig system 10.

Figure 21:
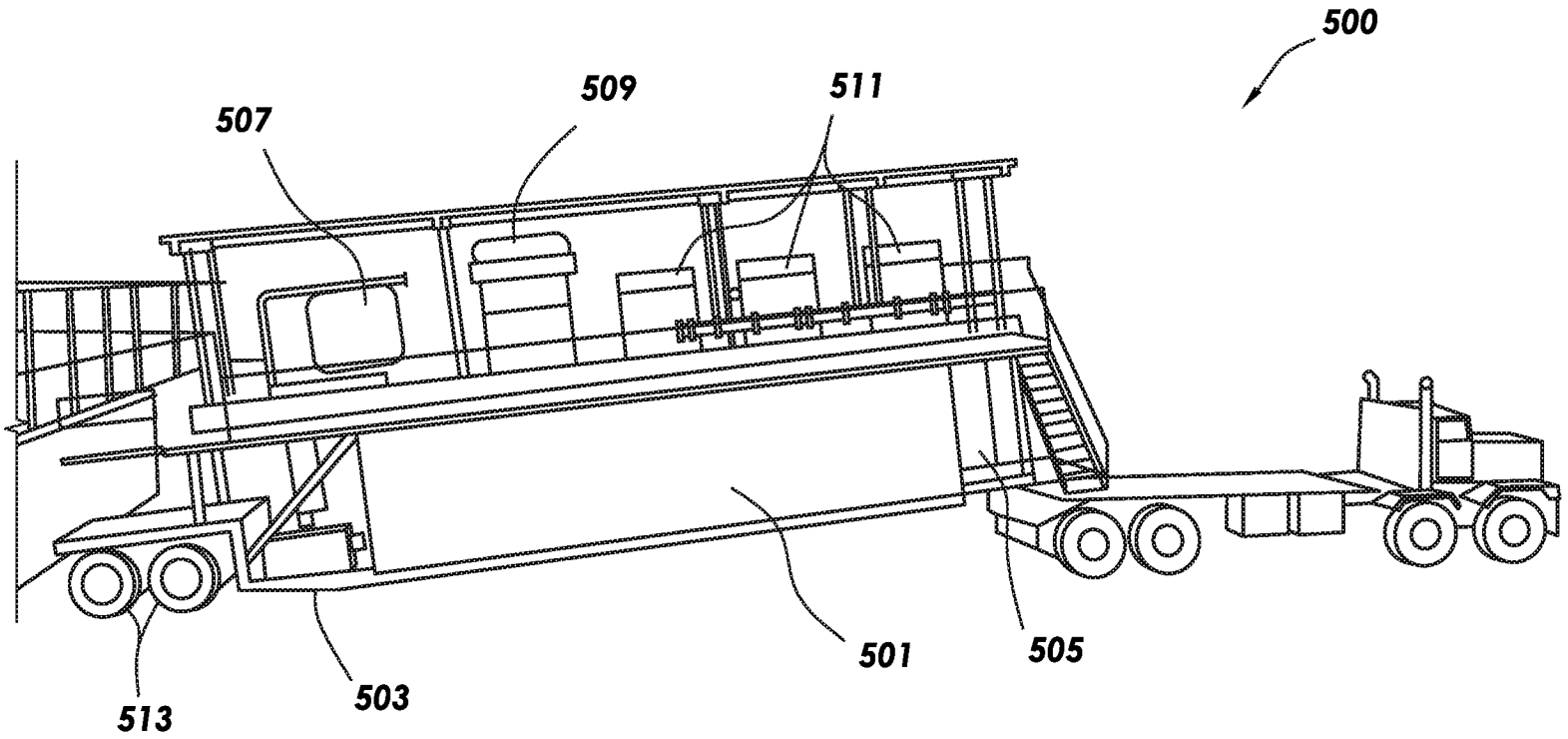
FIG. 21 depicts a mud processing skid consistent with at least one embodiment of the present disclosure.

In some embodiments, as depicted in FIGS. 1-5, automated drilling rig system 10 may include mud processing skid 500. As depicted in FIG. 21, mud processing skid 500 may include one or more pieces of equipment for processing drilling fluid used during operation of drilling rig 100. For example and without limitation, mud processing skid 500 may include one or more of mud process tank 501, transfer pumps 503, trip tank pumps 505, degasser 507, mud cleaner 509, shaker tables 511. In some embodiments, mud processing skid 500 may include one or more wheels 513 positioned to allow mud processing skid 500 to be transported, for example and without limitation, by towing.

In some embodiments, as depicted in FIGS. 1-5, automated drilling rig system 10 may include mud gas separator skid 600. Mud gas separator skid 600 may include mud gas separator 601. Mud gas separator 601 may be adapted to separate gases from drilling fluid used during operation of drilling rig 100.

In some embodiments, as depicted in FIGS. 1-5, automated drilling rig system 10 may include HPU skid 700. HPU skid 700 may include HPU 701 that may be used to provide pressurized hydraulic fluid to drilling rig 100 and other components of automated drilling rig system 10. In some embodiments, HPU skid 700 may include accumulator 703 positioned to provide hydraulic power to and control a BOP. In some embodiments, HPU skid 700 may include an air compressor positioned to provide high pressure air to components of automated drilling rig system 10. In some embodiments, HPU skid 700 may include one or more wheels 705 and hitch 707 positioned to allow HPU skid 700 to be transported, for example and without limitation, by towing.

Figure 22A:
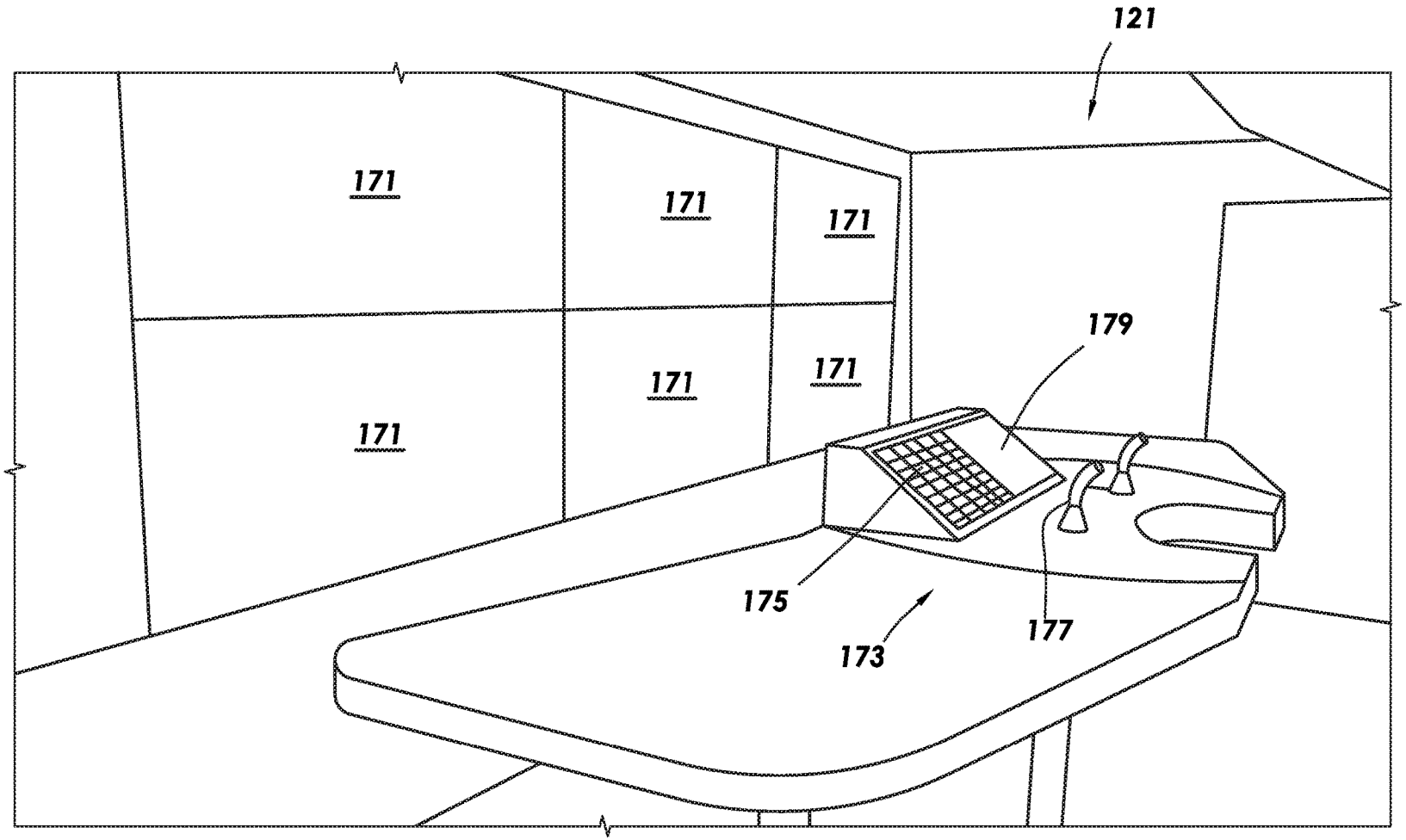
FIGS. 22A-C depict the interior of a driller's cabin of a drilling rig consistent with at least one embodiment of the present disclosure.

In some embodiments, automated drilling rig system 10 may be transported to the wellsite and the components thereof arranged about the wellbore. In some embodiments, as depicted in FIG. 5, most or all components of automated drilling rig system 10 may be positioned to one side of drilling rig 100 and out of line of the direction in which mast 119 is located when in the horizontal position. In some embodiments, each component of automated drilling rig system 10 may then be operably coupled to each other as necessary. Mast 119 may be coupled to drilling rig 100 and may be raised to the vertical position. Drilling rig 100 may be transported with rig floor 101 in the lowered transport position. Once mast 119 is placed in the vertical position, rig floor 101 may be moved to the raised deployed position as described above. Drilling rig 100 may then be in an operational configuration. In some embodiments, drilling rig 100 may also be transportable with rig floor 101 in the raised deployed position In some embodiments, as depicted in FIGS. 1-5, drilling rig 100 may include driller's cabin 121. Driller's cabin 121 may include one or more control apparatuses and user interfaces for allowing a driller to operate drilling rig 100. In some embodiments, for example and without limitation, as depicted in FIG. 22A, driller's cabin 121 may include one or more screens 171 positioned to provide information to an operator regarding, for example and without limitation, operational information relating to drilling rig 100. In some embodiments, driller's cabin 121 may include control station 173. Control station 173 may include one or more input devices such as buttons 175, joysticks 177, and touchscreens 179, as well as additional other interface devices.

Figure 22B:
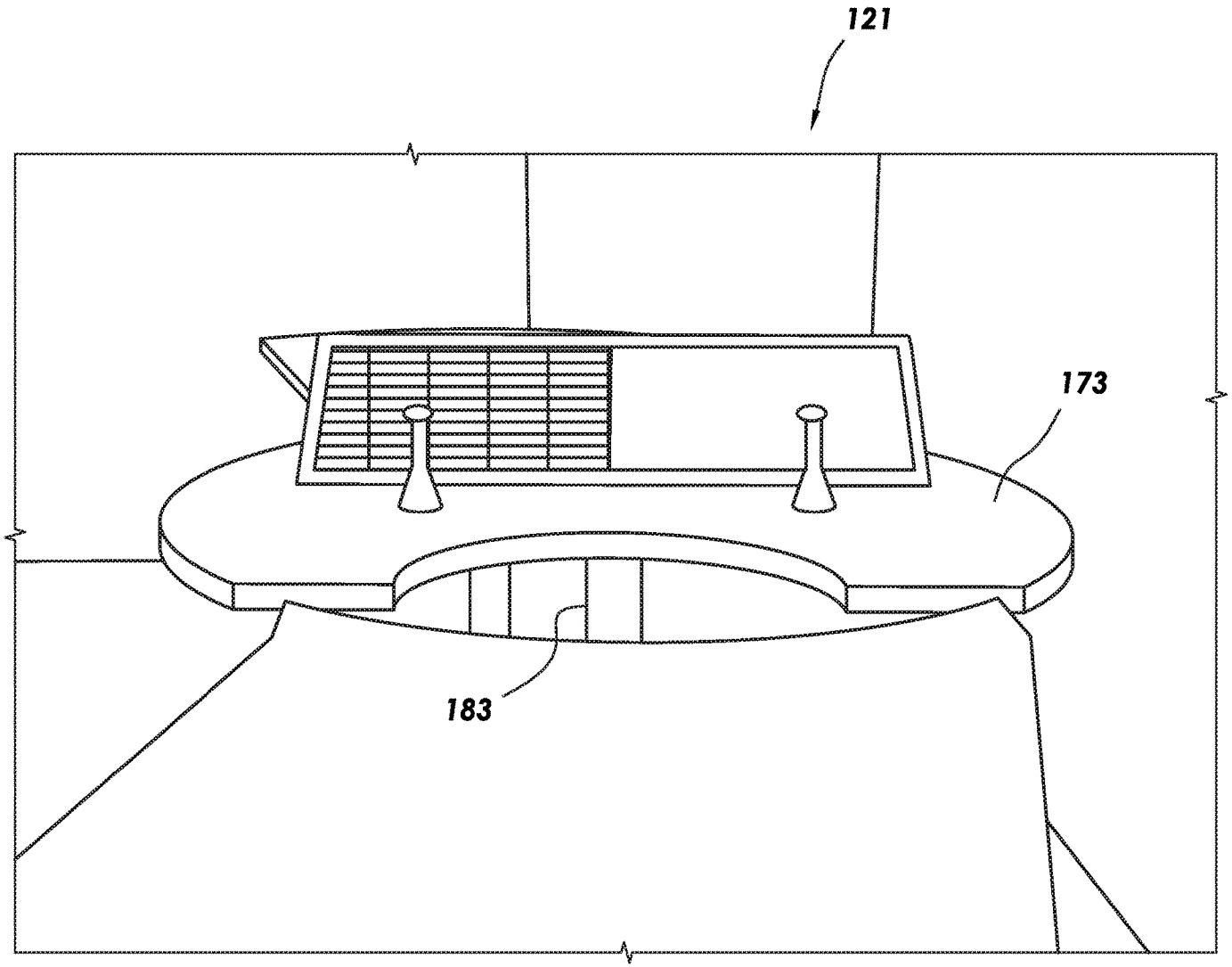
Figure 22C:
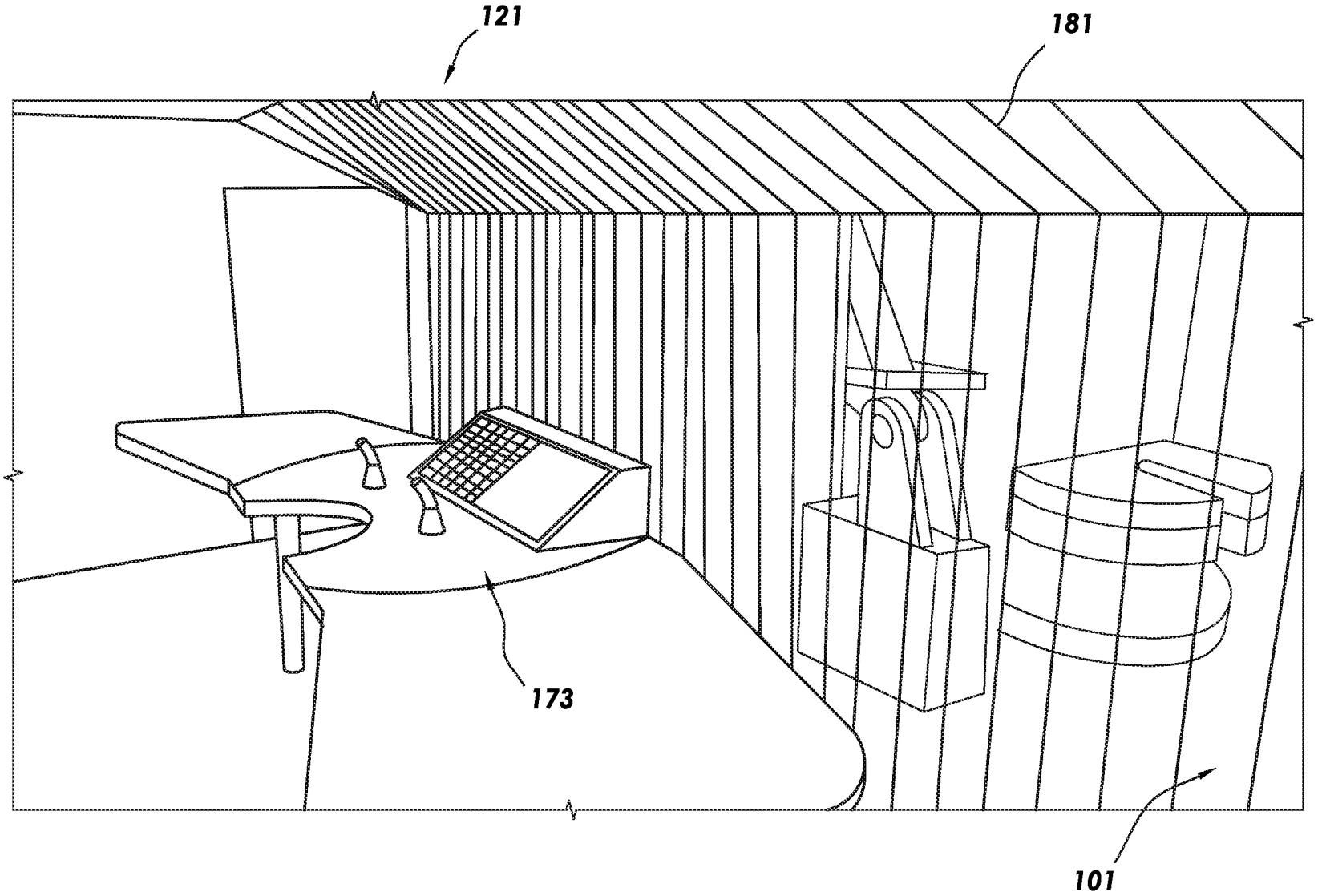

In some embodiments, control station 173 may be positioned centrally within driller's cabin 121. In some embodiments, control station 173 may be rotatable relative to driller's cabin 121 as shown in FIGS. 22A-C. In some such embodiments, control station 173 may be rotatable between a first position, as shown in FIG. 22A, and a second position, as shown in FIG. 22C. In the first position, the operator may use control station 173 and view screens 171. In the second position, the operator may view rig floor 101 through windows 181 of driller's cabin 121 while using control station 173. In some embodiments, as depicted in FIG. 22B, control station 173 may be pivotably mounted to the floor of driller's cabin 121 by control station support 183.

In some embodiments, automated drilling rig system 10 may be configured such that operation of drilling rig 100 may be achieved without any human interaction beyond an operator at control station 173 once automated drilling rig system 10 is rigged up.

Figure 23:
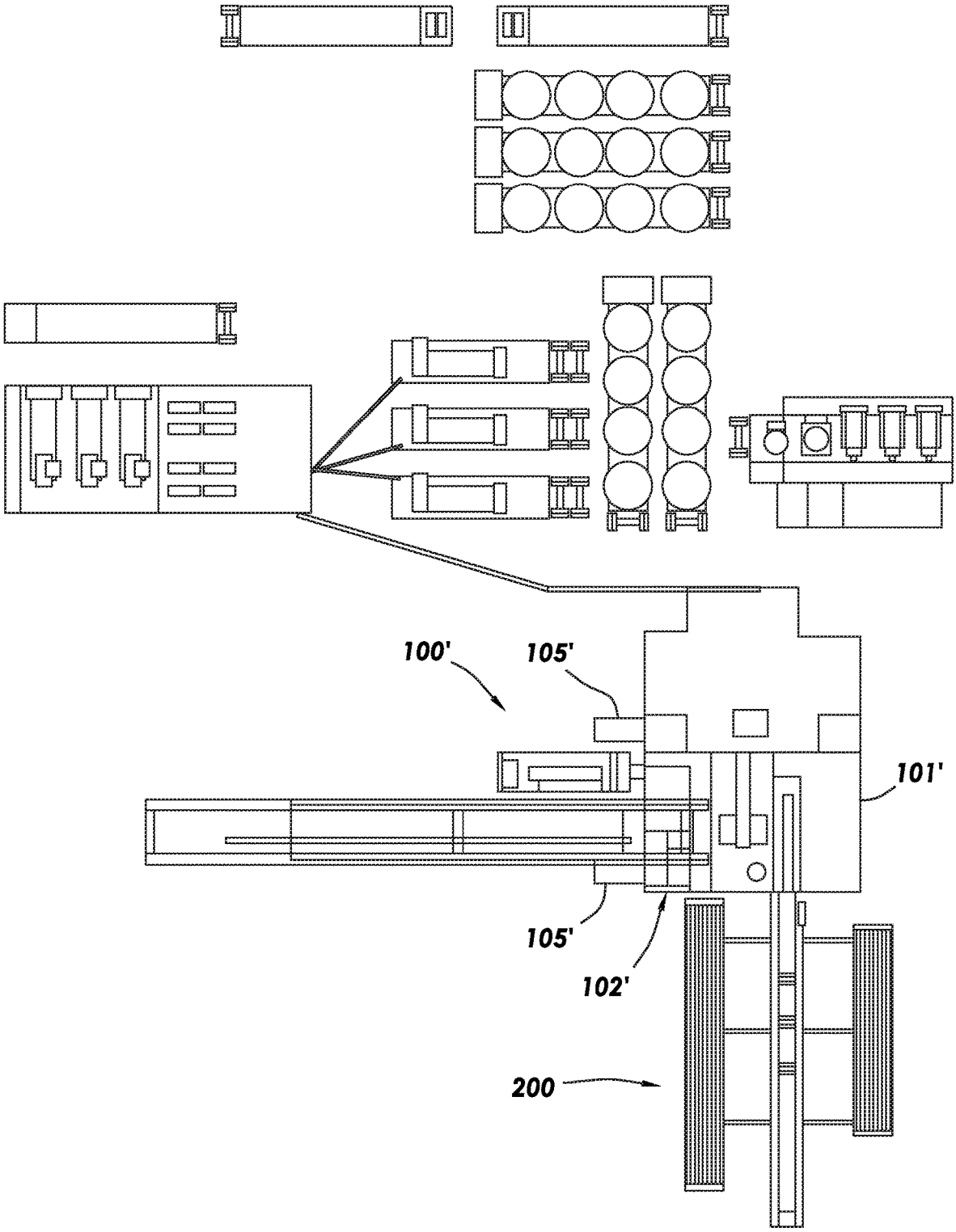
FIG. 23 depicts a top layout view of an automated drilling rig system consistent with at least one embodiment of the present disclosure.

In some embodiments, as depicted in FIGS. 1-5, drilling rig 100 may be positioned such that V-door side 102 of rig floor 101 is positioned above substructure corridor 106, such that catwalk assembly 201 extends parallel to lower boxes 105 and tubular members are introduced to rig floor 101 in a direction parallel to the extent of lower boxes 105. In other embodiments, as depicted in FIG. 23, rig floor 101' of drilling rig 100' may be oriented such that V-door side 102' of rig floor 101' is positioned above one of lower boxes 105' such that catwalk assembly 201 extends perpendicular to the extent of lower boxes 105' and tubular members are introduced to rig floor 101' in a direction perpendicular to the extent of lower boxes 105'.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An automated drilling rig system comprising:
- a drilling rig, the drilling rig including:
  - a rig floor;
  - a substructure;
  - a mast;
  - a top drive; and
  - a pipe handling apparatus, the pipe handling apparatus including a column, the column coupled to the rig floor at a position offset from the well centerline;
- a catwalk system, the catwalk system including:
  - a pipe tub;
  - a catwalk lift frame, the catwalk lift frame coupled to the rig floor; and a catwalk assembly, the catwalk assembly including a base and a catwalk slide, the catwalk lift frame coupled to the base of the catwalk assembly and extending substantially vertically to the rig floor; the pipe tub coupled to the catwalk assembly by one or more struts, the catwalk slide coupled to the catwalk lift frame at a first end and pivotably coupled to the base at a second end via a leveling strut, the catwalk slide including a skate, the skate adapted to slide along the length of the catwalk slide, wherein the lift frame comprises one or more racks positioned vertically along the lift frame, and wherein the catwalk slide further comprises one or more pinions positioned at an end of the catwalk slide closest to the drilling rig, the pinions engaged with the rack of the lift frame.

2. The automated drilling rig system of claim 1, wherein the catwalk assembly and catwalk lift frame are coupled to the drilling rig at a position offset from the well centerline such that catwalk slide is not aligned with the mast of the drilling rig.

3. The automated drilling rig system of claim 1, wherein the catwalk system further comprises one or more walkers.

4. The automated drilling rig system of claim 1, wherein the pinions of the catwalk slide are driven electrically.

5. The automated drilling rig system of claim 1, wherein the catwalk assembly further comprises a position sensor.

6. The automated drilling rig system of claim 1, wherein the pipe tub comprises one or more support frames, each support frame including one or more channels, the channels positioned to receive the ends of one or more tubular members positioned within the pipe tub, wherein the support frames are movable vertically.

7. The automated drilling rig system of claim 1, wherein the catwalk system further comprises a pipe doping skid, the pipe doping skid positioned between the pipe tub and the catwalk assembly, the pipe doping skid including one or more automated doping assemblies adapted to apply pipe dope to one or both ends of a tubular member as the tubular member moves between the pipe tub and the catwalk assembly.

8. The automated drilling rig system of claim 1, wherein the rig floor further comprises a pipe preparation skid, the pipe preparation skid positioned to receive a tubular member from the catwalk slide of the catwalk system.

9. The automated drilling rig system of claim 8, wherein the pipe preparation skid is positioned on the rig floor beside the mast.

10. The automated drilling rig system of claim 8, wherein the pipe preparation skid further comprises a top-end doping apparatus, the top-end doping apparatus adapted to apply pipe dope to the upper end of the tubular member.

11. The automated drilling rig system of claim 10, wherein the top-end doping apparatus comprises a dope brush.

12. The automated drilling rig system of claim 8, wherein the pipe preparation skid further comprises a limit switch adapted to detect the position of the tubular member.

13. The automated drilling rig system of claim 12, wherein the lower pin end doping apparatus comprises one or more brushes positioned to apply pipe dope to the lower end of the tubular member.

14. The automated drilling rig system of claim 8, wherein the pipe preparation skid further comprises a pipe profile sensor, the pipe profile sensor positioned to determine the profile of the tubular member as the tubular member is transported onto the pipe preparation skid.

15. The automated drilling rig system of claim 1, wherein the drilling rig further comprises a lower pin end doping apparatus, the lower pin end doping apparatus positioned to receive a lower end of a tubular member held by the pipe handling apparatus.

16. The automated drilling rig system of claim 1, wherein the rig floor further comprises a driller's cabin, the driller's cabin having a control station positioned therein.

17. The automated drilling rig system of claim 1, wherein a control station is pivotable between a first position facing away from the drill floor and a position facing toward the drill floor.

18. The automated drilling rig system of claim 17, further comprising one or more rig floor lifting cylinders mechanically coupled between the lower boxes and the rig floor, the rig floor lifting cylinders adapted to move the rig floor between the lowered transport position and the raised deployed position.

19. The automated drilling rig system of claim 17, wherein each lower box includes one or more sets of wheels.

20. The automated drilling rig system of claim 19, wherein the BOP cradle supports the BOP in a position such that the drilling rig may move from a lowered transport position to a raised deployed position without removing the BOP from the BOP cradle.

21. The automated drilling rig system of claim 17, wherein the substructure further comprises a BOP cradle, the BOP cradle extending between the lower boxes, the BOP cradle adapted to support a BOP during transportation of the drilling rig.

22. The automated drilling rig system of claim 1, wherein the rig floor further comprises an automated roughneck and automated pipe slips.

23. The automated drilling rig system of claim 1, wherein the substructure comprises two or more lower boxes, the lower boxes spaced apart horizontally, wherein each lower box is coupled to the drill floor by at least one strut, each strut pivotably coupled to the lower box and to the rig floor such that the rig floor may pivot between a lowered transport position and a raised deployed position.

24. The automated drilling rig system of claim 23, wherein each lower box is coupled to each set of wheels by a transport lifting cylinder, the transport lifting cylinder adapted to raise the lower box off the ground for transportation using the wheels and to lower the lower box to the ground for operation of the drilling rig.

25. The automated drilling rig system of claim 1, further comprising a generator skid, the generator skid including one or more generators and one or more power delivery cable arms adapted to provide electrical power to other components of the automated drilling rig system.

26. The automated drilling rig system of claim 1, further comprising one or more of a pump skid, mud processing skid, mud gas separator skid, HPU skid, or tank skid.

27. The automated drilling rig system of claim 1, wherein the rig floor comprises a V-door side, and wherein the V-door side is positioned above a substructure corridor defined between the lower boxes such that the catwalk assembly extends parallel to the lower boxes and tubular members are introduced to the rig floor in a direction parallel to the extent of the lower boxes.

28. The automated drilling rig system of claim 1, wherein the rig floor comprises a V-door side, and wherein the V-door side is positioned above one of the lower boxes such that the catwalk assembly extends perpendicular to the extent of the lower boxes and tubular members are introduced to the rig floor in a direction perpendicular to the extent of the lower boxes.

29. The automated drilling rig system of claim 1, wherein the automated drilling rig system operates automatically without human intervention.

30. A catwalk system for use with a drilling rig, the catwalk system including:

a pipe tub;

a catwalk lift frame, the catwalk lift frame coupled to the rig floor; and a catwalk assembly, the catwalk assembly including a base and a catwalk slide, the catwalk lift frame coupled to the base of the catwalk assembly and extending substantially vertically to the rig floor; the pipe tub coupled to the catwalk assembly by one or more struts, the catwalk slide coupled to the catwalk lift frame at a first end and pivotably coupled to the base at a second end via a leveling strut, the catwalk slide including a skate, the skate adapted to slide along the length of the catwalk slide, wherein the lift frame comprises one or more racks positioned vertically along the lift frame, and wherein the catwalk slide further comprises one or more pinions positioned at an end of the catwalk slide closest to the drilling rig, the pinions engaged with the rack of the lift frame.

31. The catwalk system of claim 30, wherein the catwalk assembly and catwalk lift frame are coupled to the drilling rig at a position offset from the well centerline such that catwalk slide is not aligned with the mast of the drilling rig.

32. The catwalk system of claim 30, wherein the catwalk system further comprises one or more walkers.

33. The catwalk system of claim 30, wherein the pinions of the catwalk slide are driven electrically.

34. The catwalk system of claim 30, wherein the catwalk assembly further comprises a position sensor.

35. The catwalk system of claim 30, wherein the pipe tub comprises one or more support frames, each support frame including one or more channels, the channels positioned to receive the ends of one or more tubular members positioned within the pipe tub, wherein the support frames are movable vertically.

36. The catwalk system of claim 30, wherein the catwalk system further comprises a pipe doping skid, the pipe doping skid positioned between the pipe tub and the catwalk assembly, the pipe doping skid including one or more automated doping assemblies adapted to apply pipe dope to one or both ends of a tubular member as the tubular member moves between the pipe tub and the catwalk assembly.

37. A method comprising:

providing a drilling rig, the drilling rig including:

a rig floor;

a substructure;

a mast;

a top drive; and a pipe handling apparatus, the pipe handling apparatus including a column, the column coupled to the rig floor at a position offset from the well centerline;

coupling a catwalk system to the drilling rig, the catwalk system including:

a pipe tub;

a catwalk lift frame, the catwalk lift frame coupled to the rig floor; and a catwalk assembly, the catwalk assembly including a base and a catwalk slide, the catwalk lift frame coupled to the base of the catwalk assembly and extending substantially vertically to the rig floor; the pipe tub coupled to the catwalk assembly by one or more struts, the catwalk slide coupled to the catwalk lift frame at a first end and pivotably coupled to the base at a second end via a leveling strut, the catwalk slide including a skate, the skate adapted to slide along the length of the catwalk slide wherein the lift frame comprises one or more racks positioned vertically along the lift frame, and wherein the catwalk slide further comprises one or more pinions positioned at an end of the catwalk slide closest to the drilling rig, the pinions engaged with the rack of the lift frame;

moving a tubular member from the pipe tub to the catwalk slide;

raising the catwalk slide to the rig floor along the lift frame;

moving the tubular member along the catwalk slide and over the rig floor using the skate; and engaging the tubular member with the pipe handling apparatus.

38. The method of claim 37, wherein the catwalk system operates without human interaction.

39. The method of claim 37, wherein the catwalk system is coupled to the drilling rig such that the catwalk extends in a direction parallel to the extent of lower boxes.

40. The method of claim 37, wherein the catwalk system is coupled to the drilling rig such that the catwalk extends in a direction perpendicular to the extent of lower boxes.

41. The method of claim 37, further comprising moving the tubular member along the catwalk slide onto a pipe preparation skid positioned on the rig floor.

42. The method of claim 41, further comprising applying pipe dope to an upper connection of the tubular member with a top-end doping apparatus.

43. The method of claim 41, wherein the catwalk system operates without human intervention.

44. The method of claim 41, wherein the catwalk system operates by electric power.

45. The method of claim 37, further comprising lifting the tubular member with the pipe handling apparatus to a substantially vertical position.

46. The method of claim 45, further comprising:

positioning the tubular member above a lower pin end doping apparatus positioned in the rig floor;

lowering the tubular member into the lower pin end doping system; and applying pipe dope to the lower end of the tubular member.

47. The method of claim 45, further comprising moving the tubular member into a position in line with a wellbore with the pipe handling apparatus.

48. The method of claim 47, wherein the drilling rig further comprises an automated roughneck, and wherein the method further comprises positioning the tubular member in line with a drill string positioned within the automated roughneck with the pipe handling apparatus.

49. The method of claim 48, further comprising:

actuating a stabbing guide of the automated roughneck; and aligning the tubular member with the drill string with the stabbing guide.

50. The method of claim 47, further comprising:

lowering the tubular member into engagement with the drill string with the pipe handling apparatus;

rotating the tubular member with the pipe handling apparatus to engage the tubular member with the drill string; and completing the connection between the tubular member and the drill string with an automated roughneck.

51. A method comprising:

providing a catwalk system, the catwalk system including:

a pipe tub, the pipe tub having a first tubular member positioned therein, the pipe tub including a frame and at least one support frame, the support frame having at least one channel wherein the first tubular member is at least partially positioned within the channel;

a catwalk lift frame, the catwalk lift frame coupled to the rig floor; and a catwalk assembly, the catwalk assembly including a base and a catwalk slide, the catwalk lift frame coupled to the base of the catwalk assembly and extending substantially vertically to the rig floor; the pipe tub coupled to the catwalk assembly by one or more struts, the catwalk slide coupled to the catwalk lift frame at a first end and pivotably coupled to the base at a second end via a leveling strut, the catwalk slide including a skate, the skate adapted to slide along the length of the catwalk slide wherein the lift frame comprises one or more racks positioned vertically along the lift frame, and wherein the catwalk slide further comprises one or more pinions positioned at an end of the catwalk slide closest to the drilling rig, the pinions engaged with the rack of the lift frame;

raising the first tubular member above the frame of the pipe tub using the support frame;

rolling the tubular along the one or more struts; and receiving the tubular with the catwalk slide.

* * * * *